US007000579B2

(12) United States Patent
Inomoto et al.

(10) Patent No.: US 7,000,579 B2
(45) Date of Patent: Feb. 21, 2006

(54) VALVE SYSTEM FOR INTERNAL COMBUSTION ENGINE

(75) Inventors: Yutaka Inomoto, Wako (JP); Masahiro Kuroki, Wako (JP); Tomomi Ishikawa, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/038,701

(22) Filed: Jan. 20, 2005

(65) Prior Publication Data

US 2005/0166875 A1 Aug. 4, 2005

(30) Foreign Application Priority Data

Jan. 20, 2004 (JP) ..... 2004-012495

(51) Int. Cl.
*F01L 1/34* (2006.01)

(52) U.S. Cl. ..... 123/90.16; 123/90.15; 123/90.17; 123/90.22; 123/90.31

(58) Field of Classification Search ..... 123/90.16
See application file for complete search history.

(56) References Cited

U.S. PATENT DOCUMENTS

| | | | | |
|---|---|---|---|---|
| 6,019,076 | A | 2/2000 | Pierik et al. | |
| 6,401,677 | B1 | 6/2002 | Rohe et al. | |
| 6,745,734 | B1 * | 6/2004 | Pierik | 123/90.16 |
| 2004/0007194 | A1 | 1/2004 | Iizuka | |

FOREIGN PATENT DOCUMENTS

| | | |
|---|---|---|
| EP | 1 329 621 | 7/2003 |
| EP | 1 365 116 | 11/2003 |

* cited by examiner

*Primary Examiner*—Thomas Denion
*Assistant Examiner*—Kyle M Riddle
(74) *Attorney, Agent, or Firm*—Hamre, Schumann, Mueller & Larson, P.C.

(57) ABSTRACT

A valve system is provided to eliminate a play at connection portions in a valve characteristic varying mechanism and to enhance the accuracy in control of valve operation characteristics.

5 Claims, 12 Drawing Sheets

FIG 10A
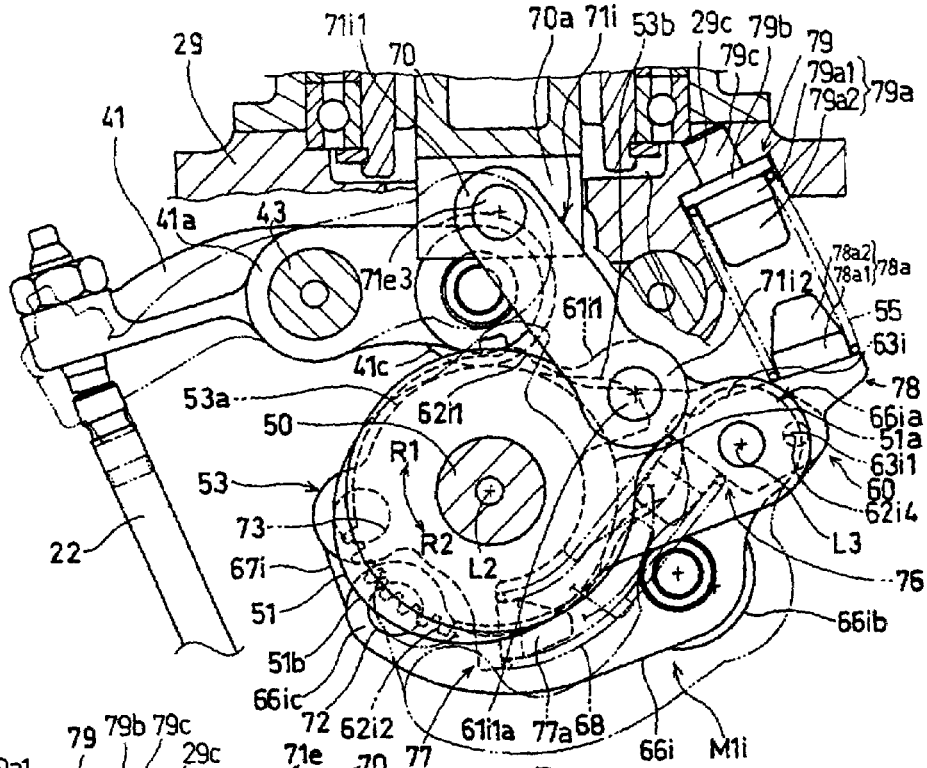
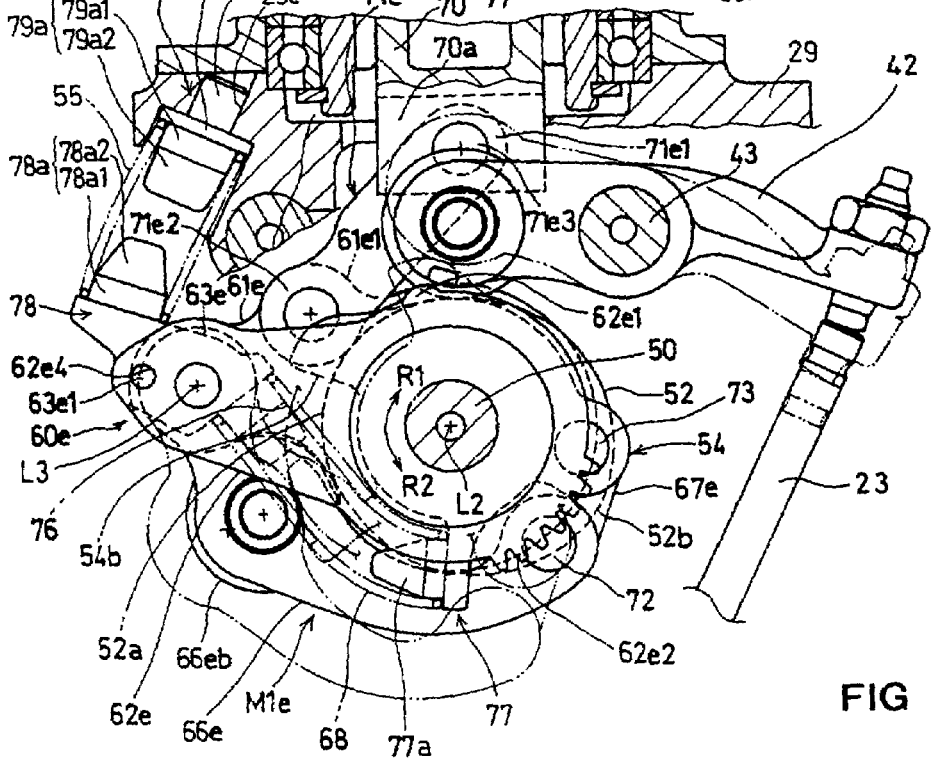
FIG 10B

FIG. 11A
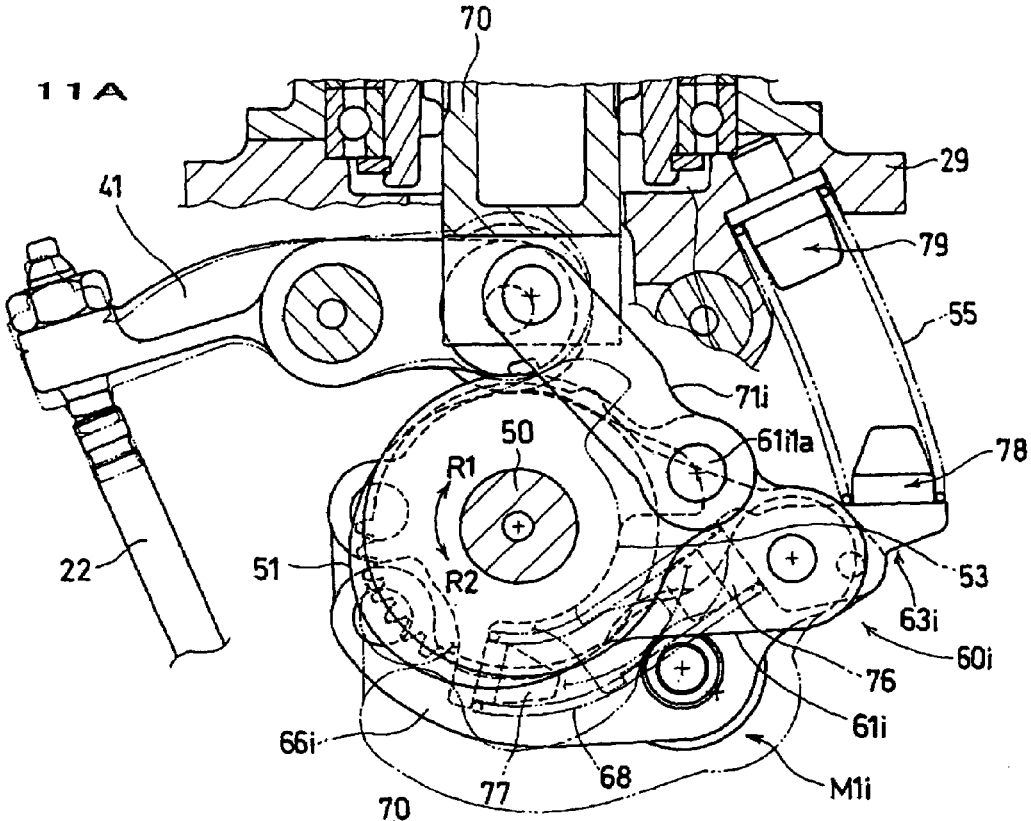
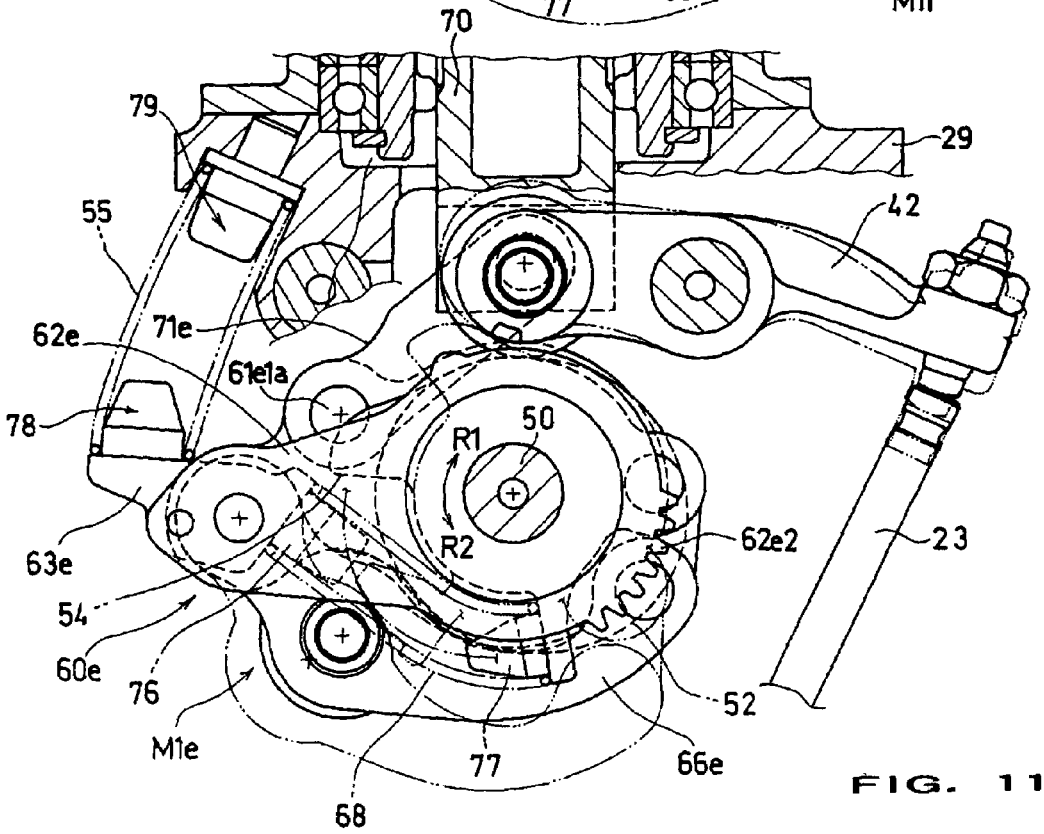
FIG. 11B

FIG. 12A
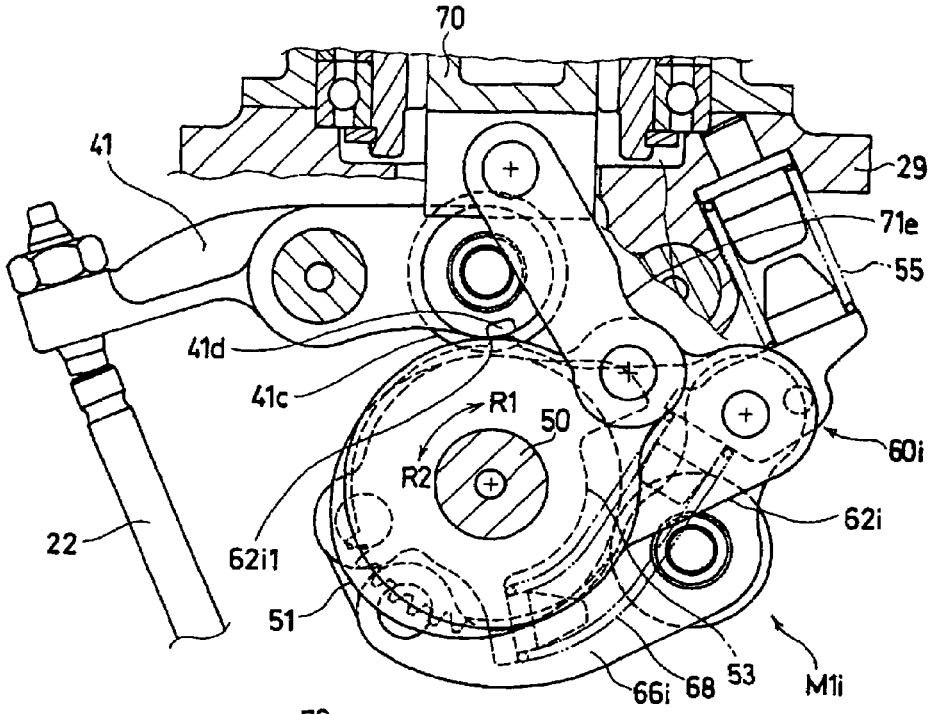
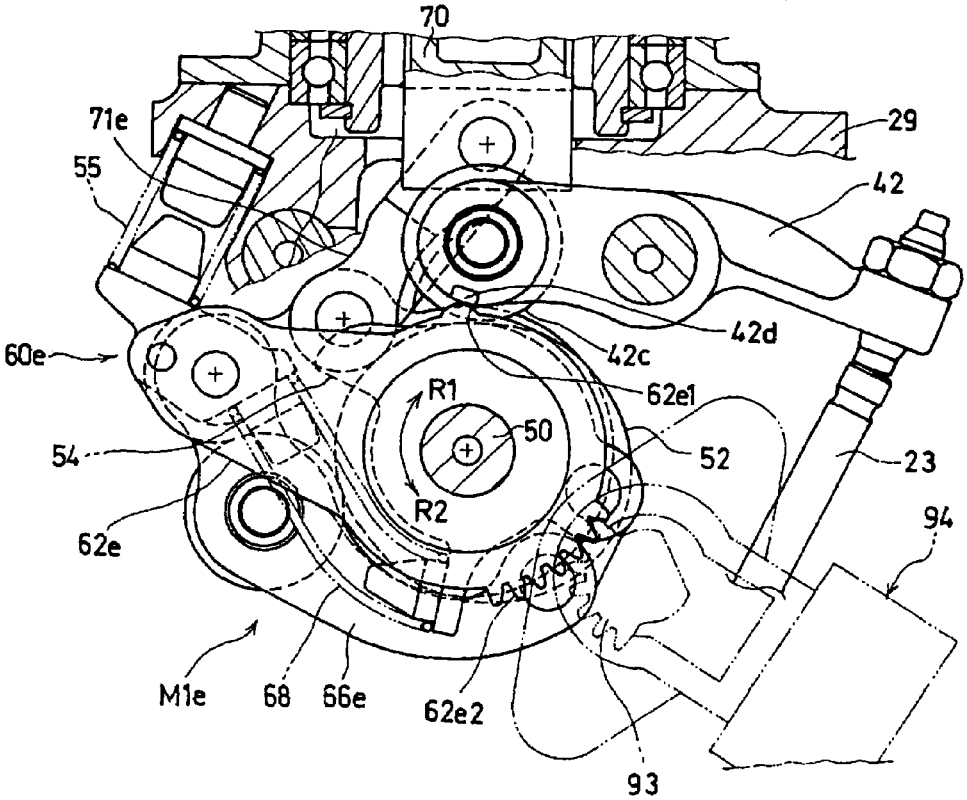
FIG. 12B

VALVE SYSTEM FOR INTERNAL COMBUSTION ENGINE

FIELD OF THE INVENTION

The present invention relates to a valve system for an internal combustion engine, and particularly to a valve system comprising a valve characteristic varying mechanism for controlling the valve operation characteristics of an engine valve composed of an intake valve or an exhaust valve.

BACKGROUND OF THE INVENTION

As a variable valve mechanism provided for an internal combustion engine and capable of changing the opening and closing timings and the maximum lift amount of an engine valve, there are, for example, those disclosed in U.S. Pat. No. 6,019,076 and U.S. Pat. No. 6,401,677 (B1).

The variable valve mechanism disclosed in U.S. Pat. No. 6,019,076 comprises a swinging cam swingably supported on a camshaft for the purpose of opening and closing an intake valve or an exhaust valve, a control shaft driven by an actuator, a control lever having a drive pin and mounted to the control shaft, a control member which has a rocker lever for swinging the swinging cam by being swung by a rotary cam rotated integrally with the camshaft and which converts the motion of the control lever into a swinging motion of the swinging cam, and a spiral spring for pressing the rocker lever against the rotary cam. The control lever and the control member are connected so as to be capable of relative motions through the engagement of a slider provided on the drive pin with a slot formed in a frame of the control member, and the spiral spring is provided between the swinging cam and the frame.

In addition, the variable valve mechanism disclosed in U.S. Pat. No. 6,401,677 (B1) comprises an output cam swingably supported on a camshaft for the purpose of opening and closing an intake valve or an exhaust valve, a frame which supports a rocker arm for swinging the output cam by being swung by an input cam rotated integrally with the camshaft and which is driven by an actuator to swing about the camshaft, and a coil spring for pressing the rocker arm against the input cam. The coil spring is curved in an arcuate shape in its natural state, one end portion of the coil spring is held by a spring receiving cup formed integrally with the output cam, and the other end of the coil spring is held by a spring receiving cup formed integrally with the frame.

In U.S. Pat. No. 6,019,076, the control shaft driven to rotate by the actuator swings the frame, which has a slot for engagement with a slider of the control lever, about the camshaft through the slider and thereby swings the swinging cam, whereby the opening and closing timings and the maximum lift amount of the engine valve are changed. Here, a slight gap, or play, is present between the slider and the frame, for securing smooth movements of both the members. The presence of the play, however, makes it difficult to accurately transmit a motion from the control lever to the frame. For controlling the valve operation characteristics with high accuracy, therefore, it is preferable to eliminate such a play.

Besides, in U.S. Pat. No. 6,019,076, the spring for pressing the rocker lever against the rotary cam is a spiral spring so shaped as to surround the camshaft in the circumferential direction of the camshaft over the entire circumference and a plurality of times. Therefore, the variable valve mechanism is large in size. On the other hand, in U.S. Pat. No. 6,401,677 (B1), the spring for pressing the rocker arm against the input cam is a coil spring disposed over a partial range in the circumferential direction of the camshaft, and, therefore, the spring is compact in form. However, the coil spring is a special spring which is curved in an arcuate shape, so that the coil spring is high in cost.

The present invention has been made in consideration of the above-mentioned circumstances. Accordingly, it is an object of the invention to eliminate the play at a connection portion in a valve characteristic varying mechanism and to enhance the accuracy in control of valve operation characteristics. Further, it is an object of the invention to maintain a highly accurate control of the valve operation characteristics, without being affected by the opening and closing operations of the engine valve, and to restrain the abrasion due to sliding at the connection portion. A further object of the invention is to enhance the accuracy in detection of operating conditions of the valve characteristic varying mechanism, for further enhancing the accuracy in control of the valve operation characteristics. It is also an object of the invention to simplify the structure of the valve characteristic varying mechanism, and to make it possible to use a straight hollow cylindrical coil spring as a control spring for the rocker arm, thereby to reduce the cost of the valve system, to securely hold the control spring and to enhance the durability of the control spring.

SUMMARY OF THE INVENTION

A valve system for an internal combustion engine is provided comprising a valve characteristic varying mechanism which comprises a valve cam pivotally supported on a camshaft so as to open and close an engine valve composed of an intake valve or an exhaust valve, a holder pivotally supported on the camshaft, a control mechanism driven by a drive mechanism so as to swing the holder about the camshaft, and a rocker arm pivotally supported on the holder and swung by a drive cam rotated integrally with the camshaft, so as to swing the valve cam about the camshaft, the valve characteristic varying mechanism controlling the valve operation characteristics of the engine valve according to the swing position of the holder. The control mechanism and the holder are connected so as to be capable of relative motions through a control mechanism side connection portion and a holder side connection portion, and the valve characteristic varying mechanism comprises pressing energizing means for normally pressing the holder side connection portion against the control mechanism side connection portion in the swinging direction.

According to this, the holder side connection portion is normally pressed against the control mechanism side connection portion in the swinging direction by the pressing energizing means, whereby the influence of the play between both the connection portions is eliminated, and, when the control mechanism and the holder are put into relative motions for controlling the valve operation characteristics, both the members are maintained in the condition of making contact with each other in the swinging direction at their connection portions, so that the motion of the control mechanism is accurately transmitted to the holder.

Since the motion of the control mechanism of the valve characteristic varying mechanism is accurately transmitted to the holder, the motion transmission accuracy is prevented from being lowered due to the play between the connection portions of the control mechanism and the holder, so that the control accuracy of the valve operation characteristics controlled according to the swing position of the holder swung by the drive mechanism through the control mechanism is enhanced.

In the valve system for an internal combustion engine, the direction in which an energizing force of the pressing energizing means presses the holder side connection portion against the control mechanism side connection portion is the same as the direction in which a reaction force exerted on the valve cam by the engine valve when the valve cam opens the engine valve presses the holder side connection portion against the control mechanism side connection portion.

According to this, the energizing force of the pressing energizing means is not cancelled by the reaction force exerted from the engine valve, and, therefore, the contact condition between the control mechanism and the holder is maintained irrespectively of the opening and closing operations of the engine valve. In addition, since the energizing force need not overcome the reaction force, the energizing force of the pressing energizing means can be reduced insofar as the contact condition between the control mechanism and the holder is maintained, and abrasion of the connection portions due to sliding is restrained.

Since the motion of the control mechanism is accurately transmitted to the holder irrespectively of the opening and closing operations of the engine valve, a highly accurate control of the valve operation characteristics is maintained. In addition, since the energizing force can be minimized in a required range, abrasion due to sliding at the connection portions is restrained, durability at the connection portions is enhanced, a highly accurate control of the valve operation characteristics is maintained over a long time, and the pressing energizing means is reduced in size and weight.

In the valve system for an internal combustion engine, the valve system may further comprise swing position detection means for detecting the swing position of the holder for the purpose of controlling the drive amount of the drive mechanism, wherein a detecting portion of the swing position detection means moves while being engaged with the holder in the swinging direction.

According to this, the holder is engaged with the detecting portion in the state of being normally pressed against the detecting portion in the swinging direction by the pressing energizing means, so that the influence of the play between the holder and the detecting portion is eliminated, the detecting portion moves while accurately following up to the motion of the holder, and the swing position of the holder is detected by the swing position detection means based on the motion of the detecting portion.

Since the motion of the holder is accurately detected by the swing position detection means, the accuracy in detection of the swing position of the holder is enhanced, and the accuracy of the valve operation characteristics effected by the valve characteristic varying mechanism controlled by the drive mechanism controlled based on the detection results is further enhanced.

In the valve system for an internal combustion engine, the valve characteristic varying mechanism comprises a control spring for pressing the rocker arm against the drive cam, the pressing energizing means is a pressing spring, and the holder is provided with a spring holding portion for holding one end portion of the pressing spring and with a spring holding portion for holding one end portion of the control spring.

According to this, the pressing spring and the control spring are both held by the holder provided with the spring holding portions, and, therefore, it is unnecessary to provide the spring holding portions in other separate members.

Since the spring holding portions for the pressing spring and the control spring are both provided in the holder, the structure of the valve characteristic varying mechanism is simplified.

In the valve system for an internal combustion engine, the valve characteristic varying mechanism comprises a control spring composed of a compression coil spring having a straight hollow cylindrical shape in the natural state so as to press the rocker arm against the drive cam, and a pair of spring holding portions for respectively holding both end portions of the control spring, each of the spring holding portions has a spring guide inserted into the inside of the end portion, and the spring guide has a base portion over which the end portion is fitted in the state of being inhibited from moving in the radial direction thereof, and a tapered portion continuous with the base portion and tapered so as to obviate interference with the control spring when the control spring is curved by swinging of the rocker arm.

According to this, the control spring is composed of a spring which has a straight hollow cylindrical shape in the natural state and which is versatile, and, therefore, the control spring is low in cost. In addition, each of the spring guide is inserted into the inside of the end portion of the control spring and the end portion is held by the base portion of the spring guide in the state of being inhibited from moving in the radial direction thereof. Therefore, each spring guide is prevented from being disengaged from the spring holding portion even when the control spring is expanded and contracted due to swinging of the rocker arm. Further, the control spring is prevented, due to the presence of the tapered portion, from making contact with the spring guide when curved into an arcuate shape due to swinging of the rocker arm.

Since the control spring is composed of a straight hollow cylindrical spring which is inexpensive, the cost of the valve system is reduced. In addition, since the straight hollow cylindrical control spring is prevented, by the spring guides inserted into the inside of the control spring at both end portions of the latter, from being disengaged from the spring holding portions, the control spring is assuredly held by the spring holding portions. Moreover, since the control spring is prevented from making contact with the spring guides even when curved into an arcuate shape, durability of the control spring is enhanced.

BRIEF DESCRIPTION OF THE DRAWINGS

FIG. 10 shows the valve system for the internal combustion engine of FIG. 1, in which (A) is an illustration of an essential part of the valve characteristic varying mechanism when a maximum valve operation characteristic is obtained in regard of the intake valve, and (B) is an illustration of an essential part of the valve characteristic varying mechanism when a maximum valve operation characteristic is obtained in regard of the exhaust valve, corresponding to an essential part enlarged view of FIG. 2.

FIG. 11(A) is a view corresponding to FIG. 10(A) when a minimum valve operation characteristic is obtained in regard of the intake valve.

FIG. 11(B) is a view corresponding to FIG. 10(B) when a minimum valve operation characteristic is obtained in regard of the exhaust valve.

FIG. 12(A) is a view corresponding to FIG. 10(A) when a decompression operation characteristic is obtained in regard of the intake valve.

FIG. 12(B) is a view corresponding to FIG. 10(B) when a decompression operation characteristic is obtained in regard of the exhaust valve.

DETAILED DESCRIPTION OF THE INVENTION

Now, an embodiment of the present invention will be described below, referring to FIGS. 1 to 12.

Figure 1:
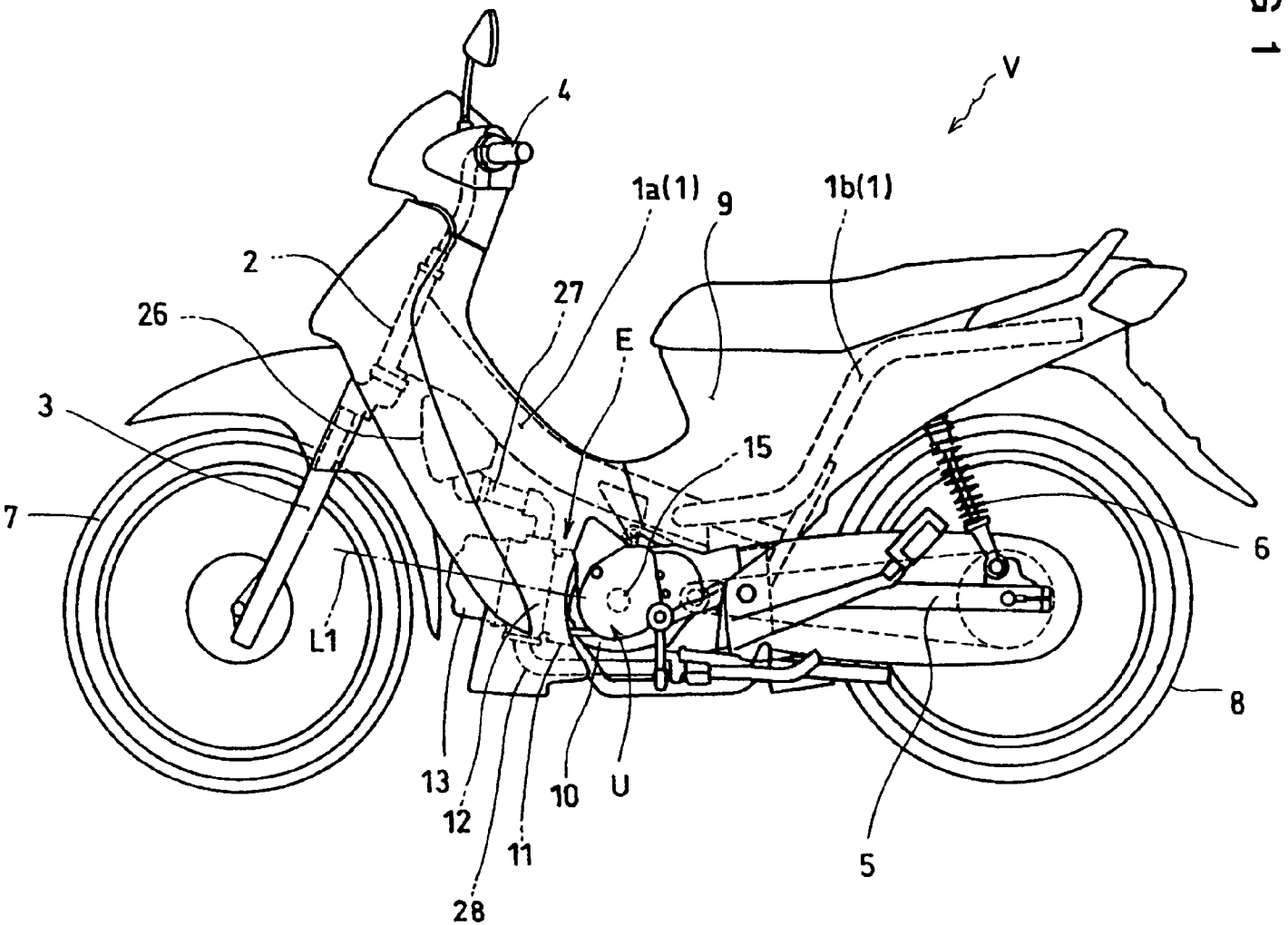
FIG. 1 is a general right side view of a motorcycle on which an internal combustion engine according to the present invention is mounted.

Referring to FIG. 1, an internal combustion engine E to which the present invention is applied is mounted on a motorcycle V representative of a vehicle. The motorcycle V comprises a vehicle body frame 1 having a front frame 1*a* and a rear frame 1*b*, a steering handle 4 fixed to an upper end portion of a front fork 3 rotatably supported on a head pipe 2 connected to the front end of the front frame 1*a*, a front wheel 7 rotatably supported on lower end portions of the front fork 3, a power unit U supported on the vehicle body frame 1, a rear wheel 8 rotatably supported on a rear end portion of a swing arm 5 swingably supported on the vehicle body frame 1, a rear cushion 6 for connection between the rear frame 1*b* and a rear portion of the swing arm 5, and a vehicle body cover 9 covering the vehicle body frame 1.

The power unit U comprises a transverse layout type internal combustion engine E having a crankshaft 15 extending in the left-right direction of the motorcycle V, and a power transmission device having a transmission and transmitting the power of the internal combustion engine E to the rear wheel 8. The internal combustion engine E comprises a crankcase 10 forming a crank chamber in which to contain the crankshaft 15 and serving also as a transmission case, a cylinder 11 connected to the crankcase 10 and extending forwards, a cylinder head 12 connected to a front end portion of the cylinder 11, and a head cover 13 connected to a front end portion of the cylinder head 12. The cylinder axis L1 of the cylinder 11 extends forwards, and either slightly upwards relative to the horizontal direction (see FIG. 1) or substantially in parallel to the horizontal direction. The rotation of the crankshaft 15 driven by a piston 14 (see FIG. 2) to rotate is transmitted to the rear wheel 8 through speed change by the transmission, to drive the rear wheel 8.

Figure 2:
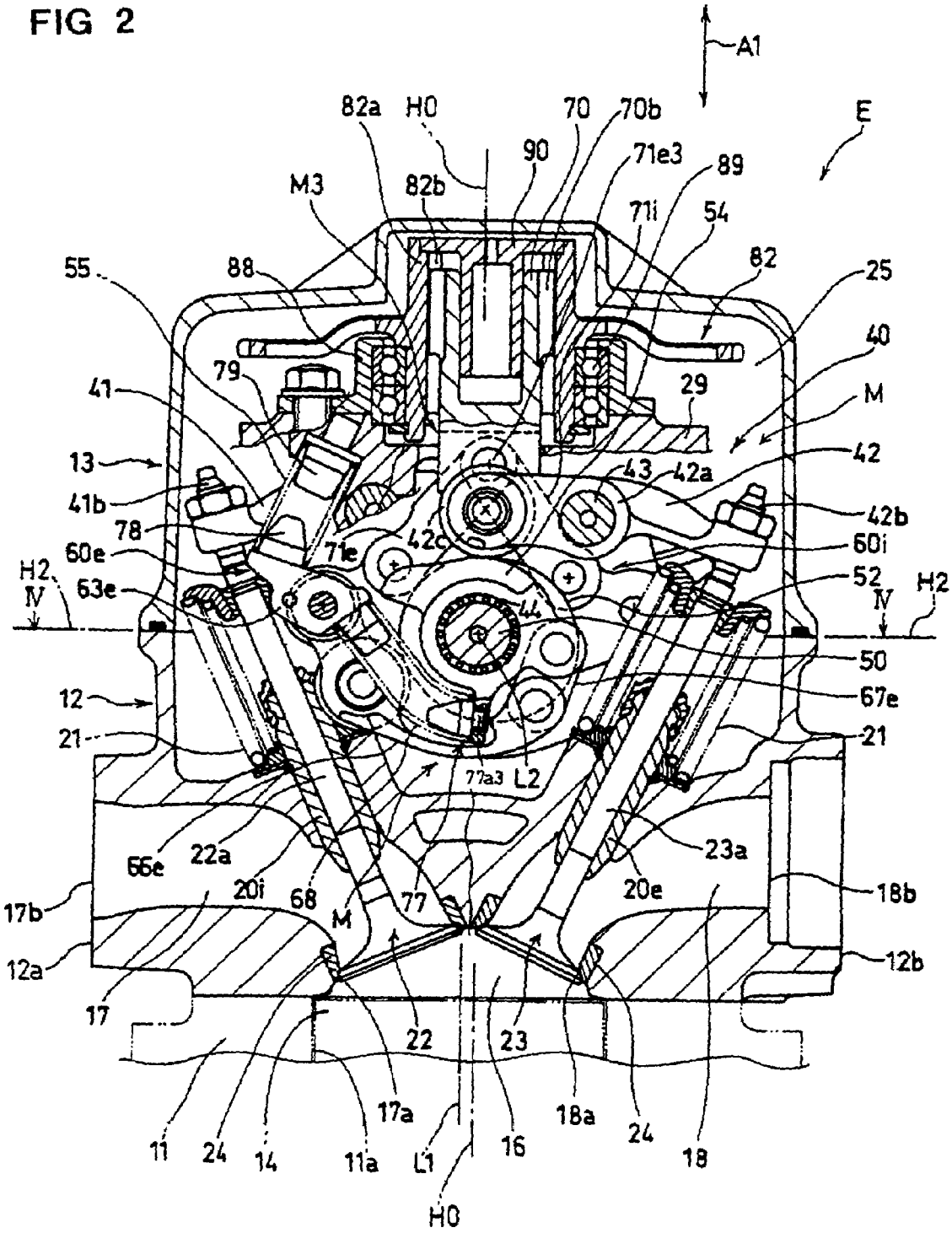
FIG. 2 is a sectional view, generally along arrow II—II of FIG. 4, of the internal combustion engine of FIG. 1, partly in section along a plane passing through the center axes of an intake valve and an exhaust valve and the center axis of a control shaft.

Referring to FIG. 2 also, the internal combustion engine E is an SOHC type air-cooled single-cylinder four-stroke internal combustion engine, in which the cylinder 11 is provided with a cylinder bore 11*a* in which the piston 14 is reciprocatably fitted, the cylinder head 12 is provided with a combustion chamber 16 on the side of facing the cylinder bore 11*a* in the cylinder axis direction A1, and further with an intake port 17 having an intake opening 17*a* opening into the combustion chamber 16 and an exhaust port 18 having an exhaust opening 18*a* opening into the combustion chamber 16. In addition, a spark plug 19 fronting on the combustion chamber 16 is inserted in a mount hole 12*c* formed in the cylinder head 12, to be mounted to the cylinder head 12. Here, the combustion chamber 16 constitutes a combustion space, together with the cylinder bore 11*a* between the piston 14 and the cylinder head 12.

Further, the cylinder head 12 is provided with one intake valve 22 and one exhaust valve 23 serving as engine valves which are reciprocatably supported by valve guides 20*i*, 20*e* and are each normally biased in the valve closing direction by a valve spring 21. The intake valve 22 and the exhaust valve 23 are put into opening and closing operations by a valve system 40 provided in the internal combustion engine E, to open and close the intake opening 17*a* and the exhaust opening 18*a* defined by valve seats 24. The valve system 40, exclusive of an electric motor 80 (see FIG. 3) is disposed in a valve chamber 25 defined by the cylinder head 12 and the head cover 13.

An intake system comprising an air cleaner 26 (see FIG. 1) and a throttle body 27 (see FIG. 1) is mounted to an upper surface 12*a*, i.e., one side surface of the cylinder head 12 in which an inlet 17*b* of the intake port 17 is opened, for leading air taken in from the exterior to the intake port 17. On the other hand, an exhaust system comprising an exhaust pipe 28 (see FIG. 1) for leading an exhaust gas flowing out from the combustion chamber 16 via the exhaust port 18 to the exterior of the internal combustion engine E is mounted a lower surface 12*b*, i.e., the other side surface of the cylinder head 12 in which an outlet 18*b* of the exhaust port 18 is opened. In addition, the intake system comprises a fuel injection valve which is a fuel supply device for supplying a liquid fuel into the intake air.

The air taken in through the air cleaner 26 and the throttle body 27 flows through the opened intake valve 22 to be taken into the combustion chamber 16 in the intake stroke in which the piston 14 is moved downwards, and the air thus taken in is compressed in the state of being mixed with the fuel in the compression stroke in which the piston 14 is moved upwards. The fuel-air mixture is combusted by ignition by the spark plug 19 at the final stage of the compression stroke, and the piston 14 driven by the pressure of the combustion gas, in the expansion stroke in which the piston 14 is moved downwards, drives the crankshaft 15 to rotate. In the exhaust stroke in which the piston 14 is moved upwards, the burned gas flows through the opened exhaust valve 23 to be discharged from the combustion chamber 16 into the exhaust port 18, as an exhaust gas.

Referring to FIGS. 2 to 5 and FIG. 10, the valve system 40 comprises an intake main rocker arm 41 as an intake cam follower abutting on a valve stem 22*a* of the intake valve 22 so as to put the intake valve 22 into opening and closing operations, an exhaust main rocker arm 42 as an exhaust cam follower abutting on a valve stem 23*a* of the exhaust valve 23 so as to put the exhaust valve 23 into opening and closing operations, and a valve characteristic varying mechanism M for controlling the valve operation characteristics including the opening and closing timings and the maximum lift amounts of the intake valve 22 and the exhaust valve 23.

The intake main rocker arm 41 and the exhaust main rocker arm 42 are rockably supported on a pair of rocker shafts 43 fixed to a camshaft holder 29 at fulcrum points 41*a*, 42*a* at central portions thereof, respectively, abut on the valve stems 22*a*, 23*a* at adjustment screws 41*b*, 42*b* constituting action portions at one-side end portions thereof, and make contact with an intake cam 53 and an exhaust cam 54 at rollers 41*c*, 42*c* constituting contact portions at other-side end portions thereof, respectively.

The valve characteristic varying mechanism M comprises an internal mechanism contained in the valve chamber 25, and the electric motor 80 which is an external mechanism disposed in the exterior of the valve chamber 25 and is an electric actuator for driving the internal mechanism. The internal mechanism comprises: one camshaft 50 rotatably supported on the cylinder head 12 and driven to rotate in conjunction with the crankshaft 15; an intake drive cam 51 and an exhaust drive cam 52 which are drive cams provided on the camshaft 50 and rotated integrally with the camshaft 50; link mechanisms M1*i*, M1*e* as interlocking mechanisms pivotally supported on the camshaft 50 and swingable about the camshaft 50; the intake cam 53 and the exhaust cam 54 which are valve cams connected to the link mechanisms M1*i*, M1*e* and pivotally supported on the camshaft 50 so as to operate the intake main rocker arm 41 and the exhaust main rocker arm 42, respectively; a drive mechanism M2 (see FIG. 3) comprising the electric motor 80 as a drive source for swinging the link mechanisms M1*i*, M1*e* about the camshaft 50; a control mechanism M3 interposed between the drive mechanism M2 and the link mechanisms M1*i*, M1*e* and controlling the swinging of the link mechanisms M1*i*, M1*e* about the camshaft 50 according to the drive force of the electric motor 80; and a pressing spring 55 as pressing energizing means for applying a torque about the camshaft 50 to the link mechanisms M1*i*, M1*e* for the purpose of pressing the link mechanisms M1*i*, M1*e* against the control mechanism M3.

Figure 3:
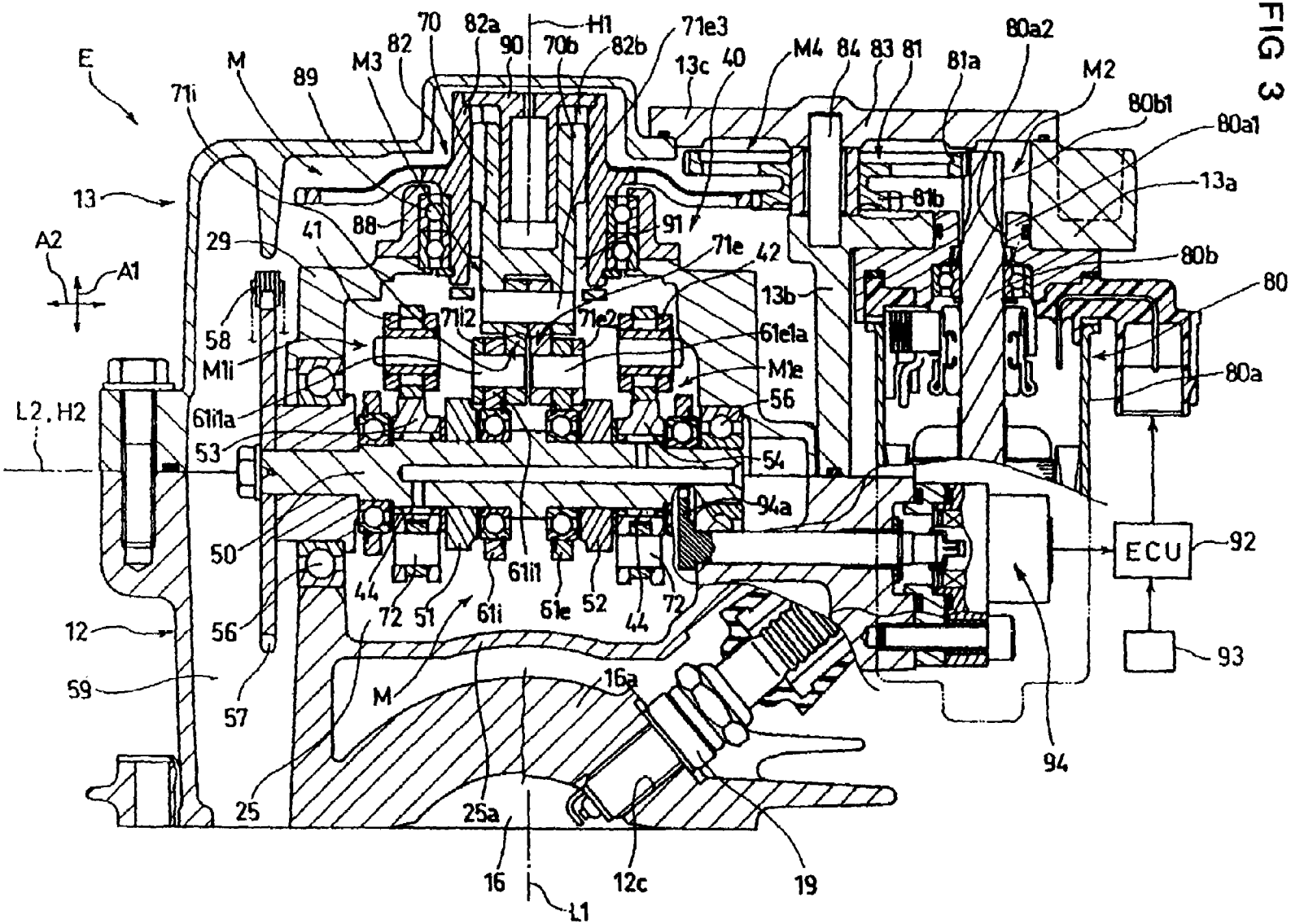
FIG. 3 is a sectional view, generally along arrow IIIa—IIIa of FIG. 8, of the internal combustion engine of FIG. 1, partly in section generally along arrow IIIb—IIIb.
Figure 4:
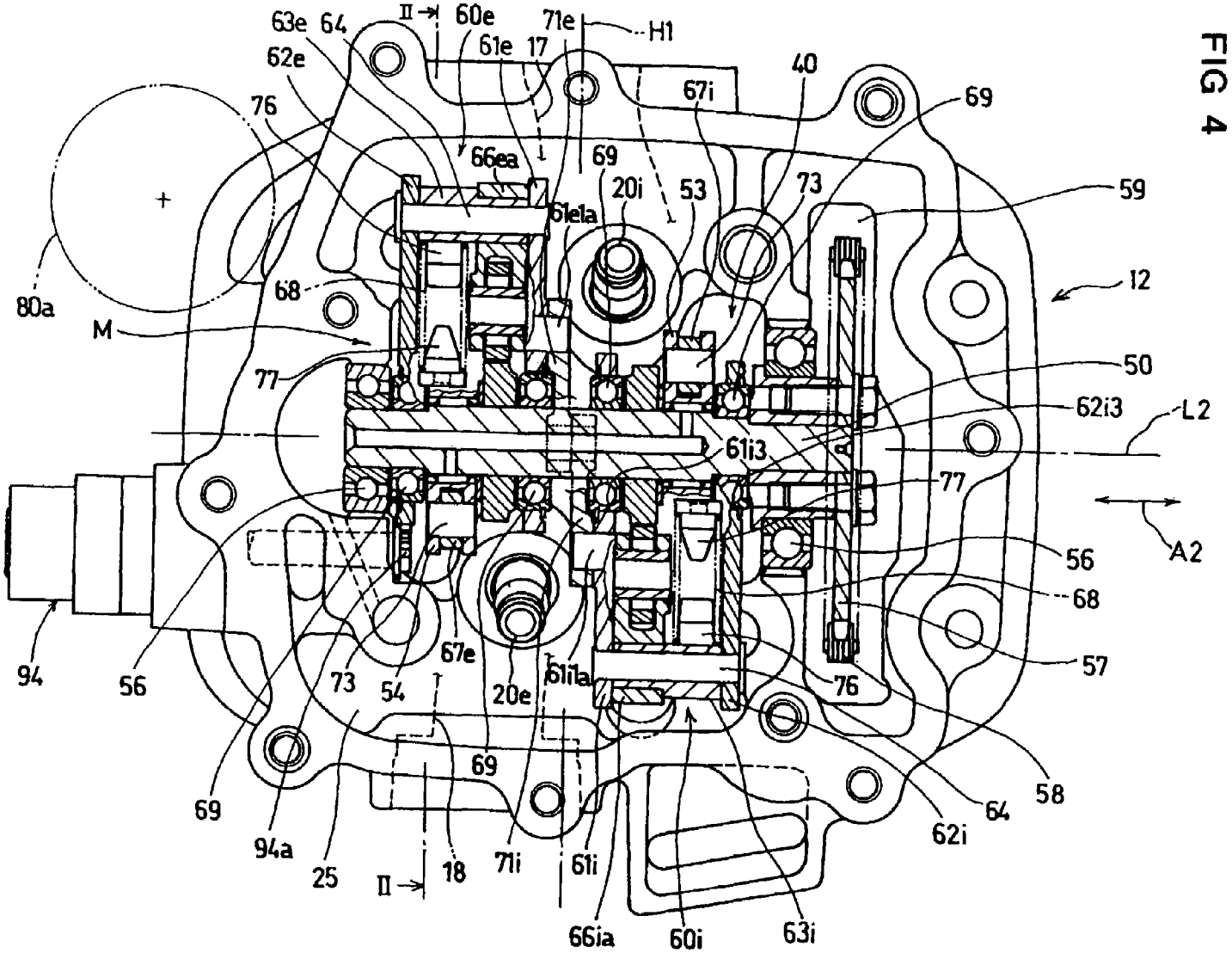
FIG. 4 is a sectional view, generally along arrow IV—IV of FIG. 2, of a valve system in the internal combustion engine of FIG. 1 with the head cover removed, partly with component members of the valve system in appropriate section.
Figure 5:
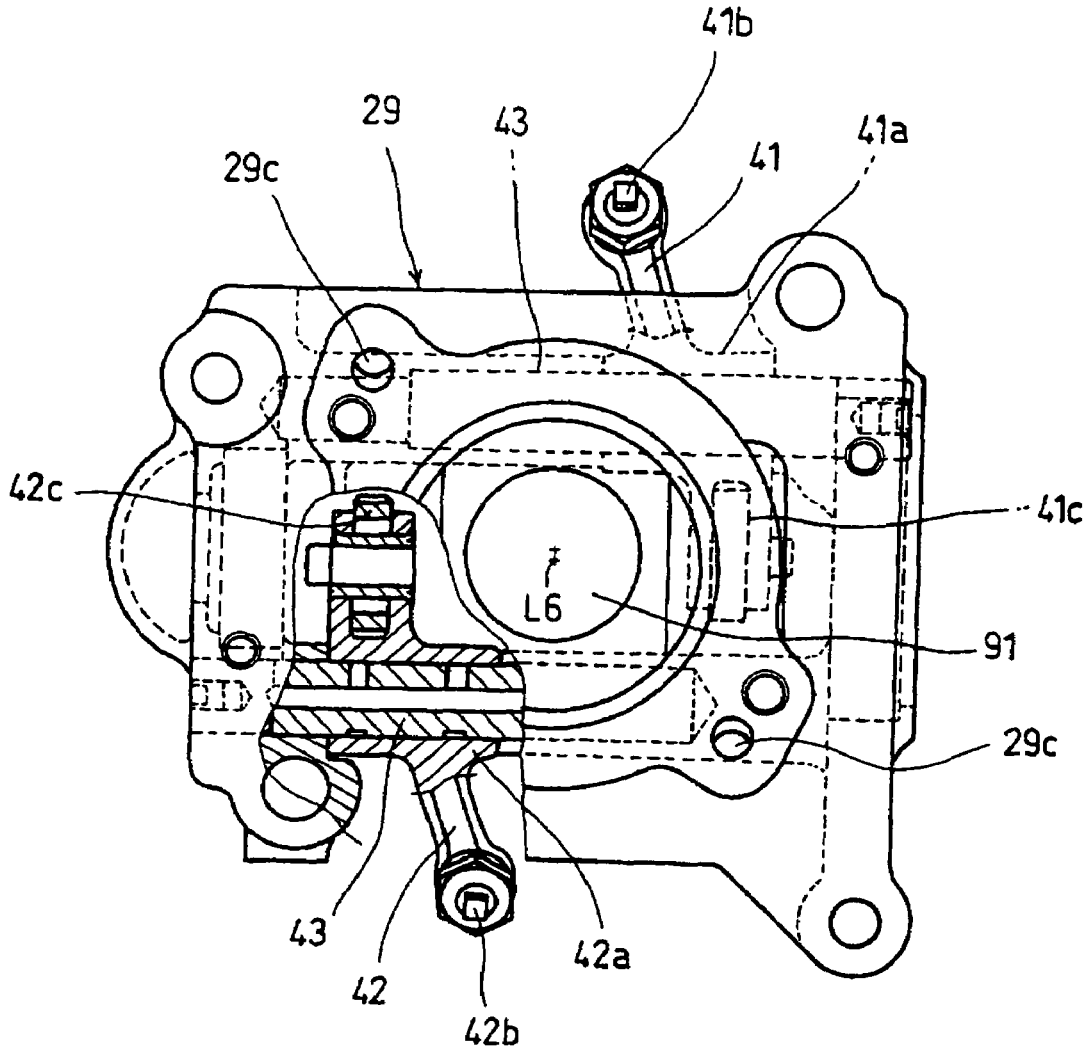
FIG. 5 is a view of a camshaft holder mounted to a cylinder head in the internal combustion engine of FIG. 1, as viewed along the cylinder axis from the head cover side.

Referring to FIGS. 2 to 4, the camshaft 50 is rotatably supported on the cylinder head 12 and a camshaft holder 29 connected to the cylinder head 12, through a pair of bearings 56 disposed at both end portions thereof, and is driven to rotate in conjunction with the crankshaft 15 (see FIG. 1) at a rotation speed of one half that of the crankshaft 15, by the power of the crankshaft 15 transmitted through a valve power transmission mechanism. The valve power transmission mechanism comprises a cam sprocket 57 integrally connected to a portion near the tip end of a left end portion, or one-side end portion, of the camshaft 50, a drive sprocket integrally connected to the crankshaft 15, and a timing chain 58 wrapped around the cam sprocket 57 and the drive sprocket. The valve power transmission mechanism is contained in a power transmission chamber which is defined by the cylinder 11 and the cylinder head 12 and is located on the left side, or one lateral side, in relation to a first orthogonal plane H1, of the cylinder 11 and the cylinder head 12. Of the power transmission chamber, a power transmission chamber 59 formed in the cylinder head 12 is adjacent to the valve chamber 25 in the radial direction with the cylinder axis L1 as a center (hereinafter referred to as "the radial direction") and in the direction A2 of the rotational center line L2 of the camshaft 50 (hereinafter referred to as "the camshaft direction A2"). Here, the first orthogonal plane H1 is a plane orthogonal to a reference plane H0 which includes the cylinder axis L1 and will be described later.

Incidentally, in the valve characteristic varying mechanism M, members relating to the intake valve 22 and members relating to the exhaust valve 23 include mutually corresponding members, and the intake drive cam 51, the exhaust drive cam 52, the link mechanisms M1*i*, M1*e*, the intake cam 53 and the exhaust cam 54 have the same basic structures; therefore, the following description will be centered on the members relating to the exhaust valve 23, and the members relating to the intake valve 22, related descriptions and the like will be parenthesized, if necessary.

Referring to FIGS. 2, 3, 6, 7 and 10, the exhaust drive cam 52 (intake drive cam 51) fixed by being press fitted to the camshaft 50 has a cam surface formed over the entire circumference of the outer circumferential surface thereof. The cam surface is composed of a base circle portion 52*a* (51*a*) for not swinging the exhaust cam 54 (intake cam 53) through the link mechanism M1*e* (M1*i*), and a cam crest portion 52*b* (51*b*) for swinging the exhaust cam 54 (intake cam 53) through the link mechanism M1*e* (M1*i*). The base circle portion 52*a* (51*a*) has an arcuate sectional shape with a fixed radius from the rotational center line L2, and the cam crest portion 52*b* (51*b*) has a sectional shape such that the radius from the rotational center line L2 increases and then decreases in the rotational direction R1 of the camshaft 50. The base circle portion 52*a* (51*a*) sets the swing position of the exhaust cam 54 (intake cam 53) so that the exhaust main rocker arm 42 (intake main rocker arm 41) makes contact with a base portion 54*a* (53*a*) of the exhaust cam 54 (intake cam 53), whereas the cam crest portion 52*b* (51*b*) sets the swing position of the exhaust cam 54 (intake cam 53) so that the exhaust main rocker arm 42 (intake main rocker arm 41) makes contact with the base circle portion 54*a* (53*a*) and the cam crest portion 54*b* (53*b*) of the exhaust cam 54 (intake cam 53).

The link mechanisms M1*i*, M1*e* are constituted of the intake link mechanism M1*i* connected to the intake cam 53, and the exhaust link mechanism M1*e* connected to the exhaust cam 54. Referring to FIG. 4 also, the exhaust link mechanism M1*e* (intake link mechanism M1*i*) comprises a holder 60*e* (60*i*) pivotally supported on the camshaft 50 and swingable about the camshaft 50, an exhaust sub rocker arm 66*e* (intake sub rocker arm 66*i*) pivotally supported on the holder 60*e* (60*i*) and driven by the exhaust drive cam 52 (intake drive cam 51) to swing, a connection link 67*e* (67*i*) pivotally supported on the exhaust sub rocker arm 66*e* (intake sub rocker arm 66*i*) at one end portion thereof and pivotally supported on the exhaust cam 54 (intake cam 53) at the other end portion thereof, and a control spring 68 for pressing the exhaust sub rocker arm 66*e* (intake sub rocker arm 66*i*) against the exhaust drive cam 52 (intake drive cam 51).

The holder 60*e* (60*i*) supported on the camshaft 50 through a bearing 69 in which the camshaft 50 is inserted comprises a pair of first and second plates 61*e* (61*i*), 62*e* (62*i*) spaced from each other in the camshaft direction A2, and a connection member for connecting the first plate 61*e*

Figure 6A:
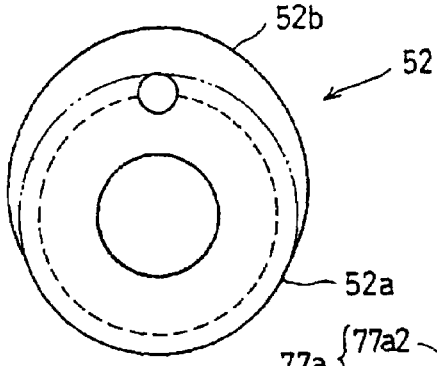
FIG. 6 shows the valve system for the internal combustion engine of FIG. 1, in which (A) is a view of an exhaust drive cam of a valve characteristic varying system as viewed in the camshaft direction, and (B) is a view of an exhaust link mechanism and an exhaust cam in the valve characteristic varying mechanism in an appropriately pivotally moved condition.
Figure 6B:
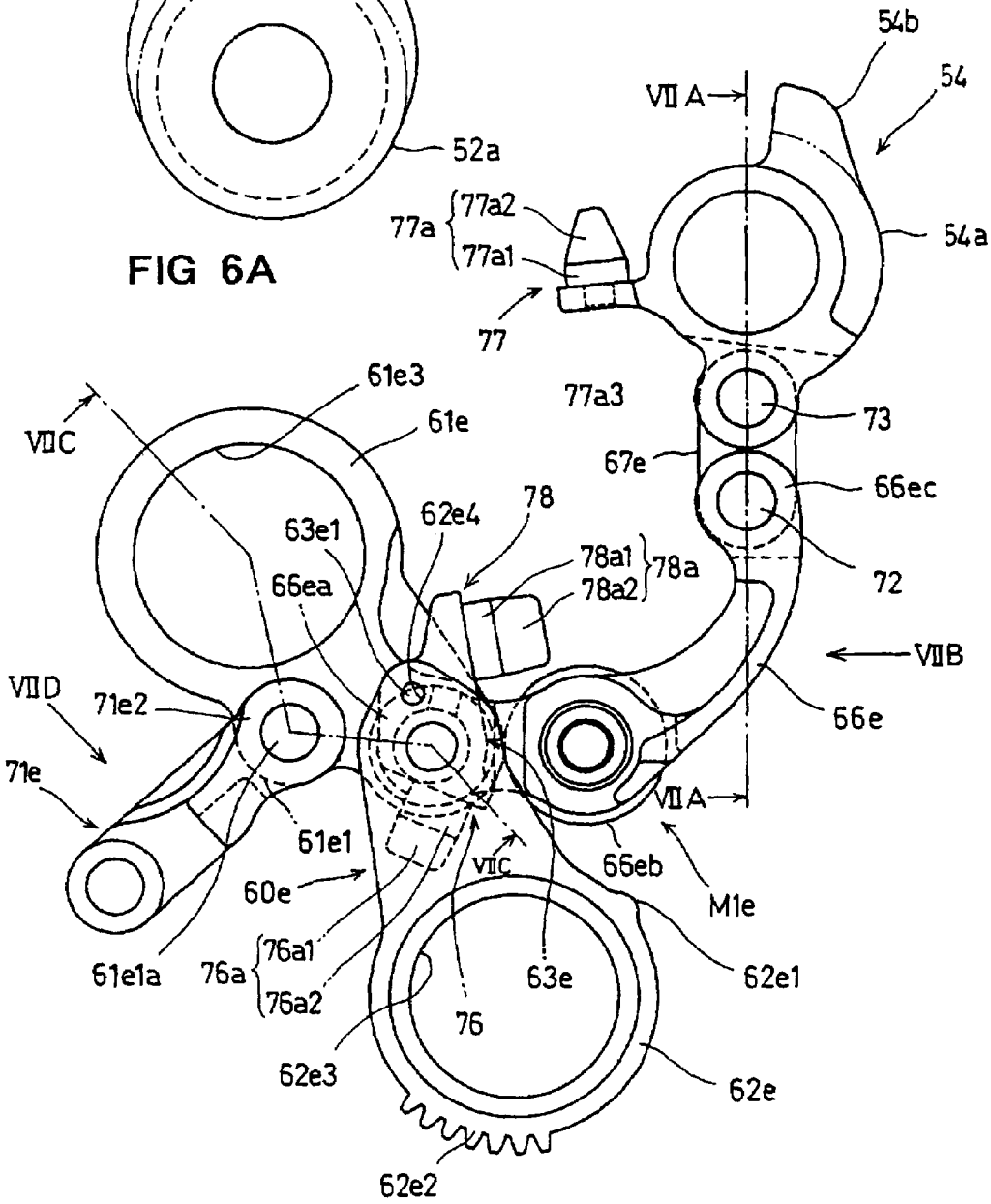
Figure 7A:
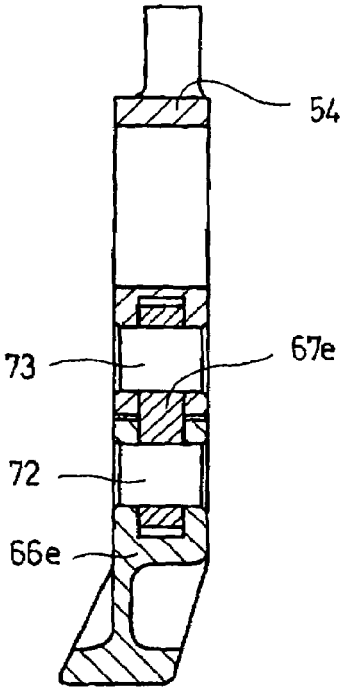
FIG. 7(A) is a sectional view along arrow VIIA of FIG. 6.
Figure 7B:
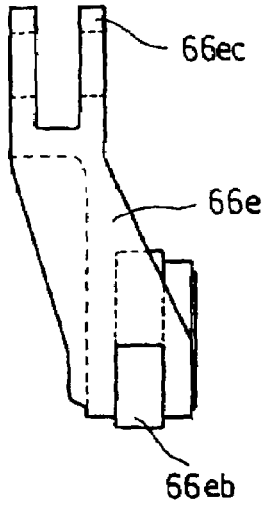
FIG. 7(B) is a view along arrow VIIB of FIG. 6.
Figure 7C:
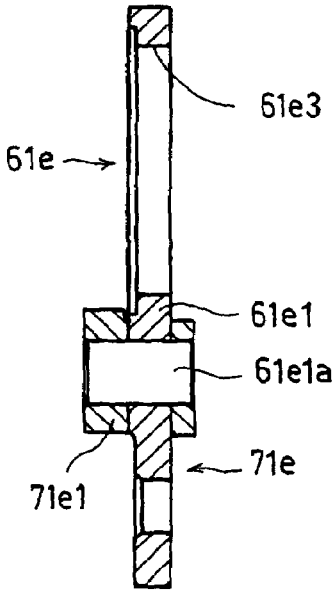
FIG. 7(C) is a sectional view along arrow VIIC of FIG. 6.
Figure 7D:
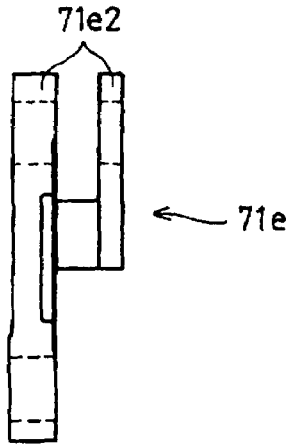
FIG. 7(D) is a view along arrow VIID of FIG. 6.

(61*i*) and the second plate 62*e* (62*i*) to each other at a predetermined interval in the camshaft direction A2 and for pivotally supporting the exhaust sub rocker arm 66*e* (intake sub rocker arm 66*i*). The connection member comprises a collar 63*e* (63*i*) determining the predetermined interval between both the plates 61*e* (61*i*), 62*e* (62*i*) and serving also as a support shaft for pivotally supporting the exhaust sub rocker arm 66*e* (intake sub rocker arm 66*i*), and a rivet 64 inserted in the collar 63*e* (63*i*) to integrally connect both the plates 61*e* (61*i*), 62*e* (62*i*) to each other. As shown in FIGS. 4 and 6, the plates 61*e* (61*i*), 62*e* (62*i*) are provided with mount holes 61*e*3 (61*i*3), 62*e*3 (62*i*3) in which to mount bearings 69 for swingably supporting the plates 61*e* (61*i*), 62*e* (62*i*) on the camshaft 50.

Referring to FIG. 3 also, an exhaust control link 71*e* (intake control link 71*i*) of the control mechanism M3 is pivotally mounted to the first plate 61*e* (61*i*), and the exhaust control link 71*e* (intake control link 71*i*) and the first plate 61*e* (61*i*) are so connected as to be capable of relative motions at their connection portions 71*e*2 (71*i*2), 61*e*1 (61*i*1). Specifically, a connection pin 61*e*1*a* (61*i*1*a*) fixed by being press fitted in a hole in the connection portion 61*e*1 (61*i*1) of the first plate 61*e* (61*i*) serving as a holder side connection portion is relatively rotatably inserted in a hole in the connection portion 71*e*2 (71*i*2) of the exhaust control link 71*e* (intake control link 71*i*) serving as a control mechanism side connection portion.

In addition, the second plate 62*e* (62*i*) is provided with a decompression cam 62*e*1 (62*i*1) (see FIGS. 6 and 10) for facilitating the starting by lowering the compression pressure through slightly opening the intake valve 22 and the exhaust valve 23 in the compression stroke at the time of starting the internal combustion engine E. Further, the second plate 62*e* is provided with a detected portion 62*e*2 to be detected by a detecting portion 94*a* of the swing position detection means 94 (see FIGS. 3 and 12). The detected portion 62*e*2 is composed of a teeth portion engaged in the swinging direction of the second plate 62*e* by being meshed with a teeth portion constituting the detecting portion 94*a*. Incidentally, though not used in this embodiment, the second plate 61*i* is also provided with a portion 62*i*2 corresponding to the detected portion 62*e*2.

The collar 63*e* (63*i*) is integrally provided with a first spring holding portion 76 for holding one end portion of a control spring 68 consisting of a compression coil spring having a straight hollow cylindrical shape in the natural state, and a movable side spring holding portion 78 for holding one end portion of the pressing spring 55 consisting of a compression coil spring having a straight hollow cylindrical shape in the natural state. Both the spring holding portions 76, 78 are disposed adjacently to a fulcrum portion 66*ea* (66*ia*) of the exhaust sub rocker arm 66*e* (intake sub rocker arm 66*i*) in the camshaft direction A2 and are disposed at an interval along the circumferential direction of the collar 63*e* (63*i*) (see FIG. 4).

In addition, the collar 63*e* (63*i*) is provided, at a position spaced from the swing center line L3 of the exhaust sub rocker arm 66*e* (intake sub rocker arm 66*i*), with a projected portion 63*e*1 (63*i*1) to be fitted in a hole 62*e*4 (62*i*4) formed in the second plate 62*e* (62*i*). The projected portion 63*e*1 (63*i*1) and the hole 62*e*4 (62*i*4) constitute an engagement portion for inhibiting relative rotations, around the swing center line L3, of the second plate 62*e* (62*i*) and the collar 63*e* (63*i*). By the engagement portion, the pair of spring holding portions 76, 78 are provided, whereby the collar 63*e* (63*i*) on which torques in the same direction are exerted by the spring forces of the control spring 68 and the pressing spring 55 is inhibited from relative rotation relative to the first and second plates 61*e* (61*i*), 62*e* (62*i*), so that the application of torques about the camshaft 50 to the link mechanisms M1*i*, M1*e* by the pressing spring 55 and the pressing thereof against the exhaust drive cam 52 (intake drive cam 51) by the control spring 68 are performed assuredly.

Referring to FIGS. 2 to 4, 6, 7 and 10, in the camshaft direction A2, the exhaust sub rocker arm 66*e* (intake sub rocker arm 66*i*) disposed between the first and second plates 61*e* (61*i*), 62*e* (62*i*) together with the exhaust cam 54 (intake cam 53) and the exhaust drive cam 52 (intake drive cam 51) makes contact with the exhaust drive cam 52 (intake drive cam 51) at a roller 66*eb* (66*ib*) serving as a contact portion for contact with the exhaust drive cam 52 (intake drive cam 51), is swingably supported on the collar 63*e* (63*i*) at the fulcrum portion 66*ea* (66*ia*) at one end portion thereof, and is pivotally supported on a connection pin 72 fixed to one end portion of the connection link 67*e* (67*i*) at the other end portion thereof. Therefore, the exhaust sub rocker arm 66*e* (intake sub rocker arm 66*i*) is swung about the collar 63*e* (63*i*) due to the rotation of the exhaust drive cam 52 (intake drive cam 51) together with the camshaft 50.

The exhaust cam 54 (intake cam 53) pivotally supported on a connection pin 73 fixed to the other end portion of the connection link 67*e* (67*i*) is composed of a swing cam supported on the camshaft 50 through the bearing 44 and thereby swingable about the camshaft 50, and is provided with a cam surface at a part of the outer circumferential surface thereof. The cam surface is composed of the base circle portion 54*a* (53*a*) for maintaining the exhaust valve 23 (intake valve 22) in the closed state, and the cam crest portion 54*b* (53*b*) for pressing down and thereby opening the exhaust valve 23 (intake valve 22). The base circle portion 54*a* (53*a*) has an arcuate sectional shape with a fixed radius from the rotational center line L2, whereas the cam crest portion 54*b* (53*b*) has such a sectional shape that the radius from the rotational center line L2 increases along the counter-rotational direction R2 (rotational direction R1) of the camshaft 50. Therefore, the cam crest portion 54*b* (53*b*) of the exhaust cam 54 (intake cam 53) has such a shape that the lift amount of the exhaust valve 23 (intake valve 22) gradually increases along the counter-rotational direction R2 (rotational direction R1).

The exhaust cam 54 (intake cam 53), on one hand, is swung about the camshaft 50 together with the exhaust link mechanism M1*e* (intake link mechanism M1*i*) by the same swing amount, by the drive force of the drive mechanism M2 transmitted through the control mechanism M3, and, on the other hand, is swung about the camshaft 50 by the exhaust sub rocker arm 66*e* (intake sub rocker arm 66*i*) swung by the exhaust drive cam 52 (intake drive cam 51). The exhaust cam 54 (intake cam 53) swung relative to the camshaft 50 swings the exhaust main rocker arm 42 (intake main rocker arm 41), thereby putting the exhaust valve 23 (intake valve 22) into opening and closing operations. Therefore, the exhaust cam 54 (intake cam 53) is swung by the drive force of the drive mechanism M2 transmitted sequentially through the holder 60*e* (60*i*), the exhaust sub rocker arm 66*e* (intake sub rocker arm 66*i*) and the connection link 67*e* (67*i*), and is swung by the drive force of the exhaust drive cam 52 (intake drive cam 51) transmitted sequentially through the exhaust sub rocker arm 66*e* (intake sub rocker arm 66*i*) and the connection link 67*e* (67*i*).

The control spring 68 for generating a spring force for pressing the roller 66*eb* (66*ib*) of the exhaust sub rocker arm 66*e* (intake sub rocker arm 66*i*) against the exhaust drive cam 52 (intake drive cam 51) is disposed between the collar 63*e* (63*i*) and the exhaust cam 54, and can be extended and contracted in the circumferential direction of the camshaft 50 according to the rocking of the exhaust sub rocker arm 66*e* (intake sub rocker arm 66*i*). One end portion of the control spring 68 is held by the first spring holding portion 76, and the other end portion is held by a second spring holding portion 77 provided at a shelf-like projected portion which is integrally formed on the exhaust cam 54 (intake cam 53).

The pressing spring 55 normally exerting on the exhaust link mechanism M1*e* (intake link mechanism M1*i*) a spring force for applying a torque directed in one sense of the swinging direction has its one end portion held by the movable side spring holding portion 78 of the holder 60*e* (60*i*), and has its other end portion held by a fixed side spring holding portion 79 provided in the camshaft holder 29 which is a fixed member fixed to the cylinder head 12.

The spring force of the pressing spring 55 for pressing the exhaust link mechanism M1*e* (intake link mechanism M1*i*) toward the side of the cylinder 11 acts directly on the holder 60*e* (60*i*) to press the holder 60*e* (60*i*) in the direction toward the cylinder 11, and the torque exerted on the holder 60*e* (60*i*) by the spring force is directed in the above-mentioned one sense. The one sense is set to be the same as the sense of the torque exerted on the exhaust cam 54 (intake cam 53) by the reaction force applied to the exhaust cam 54 (intake cam 53) from the exhaust valve 23 (intake valve 22) when the exhaust cam 54 (intake cam 53) opens the exhaust valve 23 (intake valve 22). Therefore, the sense in which the spring force of the pressing spring 55 normally presses the connection portion 61*e*1 (61*i*1) against the connection portion 71*e*2 (71*i*2) in the swinging direction is the same as the sense in which the above-mentioned reaction force presses the connection portion 61*e*1 (61*i*1) against the connection portion 71*e*2 (71*i*2) in the swinging direction, based on the torque applied from the exhaust cam 54 (intake cam 53) to the holder 60*e* (60*i*) through the connection link 67*e* (67*i*) and the exhaust sub rocker arm 66*e* (intake sub rocker arm 66*i*).

At the connection portions 71*e*2 (71*i*2), 61*e*1 (61*i*1) provided with slight gap due to the pivotal supporting, the connection portion 61*e*1 (61*i*1) on one side is normally pressed against the connection portion 71*e*2 (71*i*2) in the swinging direction by the pressing spring 55; therefore, when the first plate 61*e* (61*i*) is swung by the exhaust control link 71*e* (intake control link 71*i*), the influence of the gap (play) between the connection portion 71*e*2 (71*i*2) and the connection portion 61*e*1 (61*i*1) is eliminated, and the motion of the exhaust control link 71*e* (intake control link 71*i*) is accurately transmitted to the holder 60*e* (60*i*).

Here, referring to FIGS. 2, 4, 6 and 10, the spring holding portions 76, 77, 78, 79 will be further described. The spring holding portions 76, 77, 78, 79 have spring guides 76*a*, 77*a*, 78*a*, 79*a* which are each inserted into an end portion of the control spring 68 or an end portion of the pressing spring 55. The spring guides 76*a*, 77*a*, 78*a*, 79*a* have the same basic structure in the point of having base portions 76*a*1, 77*a*1, 78*a*1, 79*a*1 and tapered portions 76*a*2, 77*a*2, 78*a*2, 79*a*2, respectively. The base portions 76*a*1, 77*a*1, 78*a*1, 79*a*1 are each a portion over which the end portion of the control spring 68 or the pressing spring 55 is fitted in the state of being inhibited from moving in the radial direction, and the tapered portions 76*a*2, 77*a*2, 78*a*2, 79*a*2 are continuous with the base portions 76*a*1, 77*a*1, 78*a*1, 79*a*1 and are each tapered so as to obviate interference with the control spring 68 or the pressing spring 55 when the control spring 68 or the pressing spring 55 is curved and when the control spring 68 or the pressing spring 55 is in a substantially straight hollow cylindrical shape, due to the rocking of the exhaust sub rocker arm 66*e* (intake sub rocker arm 66*i*) or the swinging of the holder 60*e* (60*i*).

In this embodiment, the base portions 76*a*1, 77*a*1 of the spring guide 76*a*, 77*a* of the first and second spring holding portions 76, 77 are cylindrical, and have outside diameters roughly equal to or slightly greater than the inside diameter of the control spring 68. The tapered portions 76*a*2, 77*a*2 are in a straight truncated conical shape with a bottom portion having an outside diameter equal to the base portions 76*a*1, 77*a*1, and the outside diameter thereof decreases in the direction from the base end portion 76*a*1, 77*a*1 toward the tip end. The degree of the taper of both the tapered portions 76*a*2, 77*a*2 is so set as to avoid interference with the control spring 68 when the control spring 68 is extended and simultaneously curved according to the rocking of the exhaust sub rocker arm 66*e* (intake sub rocker arm 66*i*) and when the control spring 66 is most contracted into a substantially straight hollow cylindrical shape.

The second spring holding portion 77 comprises the spring guide 77*a* having a mount portion 77*a*3, in addition to the base portion 77*a*1 and the tapered portion 77*a*2 having the same functions as those in the first spring holding portion 76. The spring guide 77*a* is fixed to the exhaust cam 54 (intake cam 53) by inserting the mount portion 77*a*3 into a hole in the projected portion mentioned above and then plastically deforming the mount portion 77*a*3 by caulking. In addition, the heights of the spring guides 76*a*, 77*a* from respective receiving surfaces of the first and second spring holding portions 76, 77 are nearly equal in this embodiment, but they may be set to be different, taking into account the strength of the control spring 68 or the like.

Besides, when the control spring 68 is curved due to the rocking of the exhaust sub rocker arm 66*e* (intake sub rocker arm 66*i*), the curvature of curving near the spring guide 77*a* of the second spring holding portion 77 which is the movable side spring holding portion movable relative to the first spring holding portion 76 is greater than the curvature of curving near the spring guide 76*a* of the first spring holding portion 76 which is the fixed side spring holding portion. Therefore, the degree of tapering of the tapered portion 77*a*2 is set to be greater than that of the tapered portion 76*a*2, and, in this embodiment, the apex angle of the cone determining the conical surface of the tapered portion 77*a*2 is set to be smaller.

On the other hand, the base portions 78*a*1, 79*a*1 of the spring guide 78*a*, 79*a* of the movable side and fixed side spring holding portions 78, 79 are in a cylindrical shape with an outside diameter nearly equal to or slightly greater than the inside diameter of the pressing spring 55. The tapered portions 78*a*2, 79*a*2 are each in a truncated conical shape with a bottom portion having an outside diameter equal to the base portion 78*a*1, 79*a*1, and the outside diameter thereof decreases in the direction from the base portion 78*a*1, 79*a*1 toward the tip end. The degree of tapering of both the tapered portions 78*a*2, 79*a*2 is so set as to avoid interference with the pressing spring 55 when the pressing spring 55 is extended and simultaneously curved according to the swinging of the holder 60*e* (60*i*) and when the pressing spring 55 is most contracted into a substantially straight hollow cylindrical shape.

The fixed side spring holding portion 79 comprises, in an integral form, the spring guide 79*a* having a base portion 79*a*1 and the tapered portion 79*a*2 similar to those of the movable side spring holding portion 78, a flange portion 79*b* having a receiving surface on which the pressing spring 55 abuts, and a mount portion 79*c*. The fixed side spring holding portion 79 is fixed to the camshaft holder 29 by press fitting of its mount portion 79*c* into a hole 29*c* (see FIG. 5 also) in the camshaft holder 29. Besides, the heights of the spring guides 78*a*, 79*a* from respective receiving surfaces of the movable side and fixed side spring holding portions 78, 79 are nearly equal in this embodiments, but they may be set to be different, taking into account the strength of the pressing spring 55 or the like.

When the pressing spring 55 is curved due to the swinging of the holder 60*e* (60*i*) of the exhaust link mechanism M1*e* (intake link mechanism M1*i*), the curvature of curving near the spring guide 78*a* of the movable side spring holding portion 78 moved relative to the fixed side spring holding portion 79 is greater than the curvature of curving near the spring guide 79*a* of the fixed side spring holding portion 79. Therefore, the degree of tapering of the tapered portion 78*a*2 is set to be greater than that of the tapered portion 79*a*2, and, in this embodiment, the apex angle of the cone determining the conical surface of the tapered portion 78*a*2 is set to be smaller.

In the condition where the first and second spring holding portions 76, 77 are closest to each other, the control spring 68 assumes a substantially straight hollow cylindrical shape (see FIGS. 10 and 11), and, in the condition where the movable side and fixed side spring holding portions 78, 79 are closest to each other, the pressing spring 55 assumes a substantially straight hollow cylindrical shape (see FIG. 12).

Referring to FIGS. 2, 3 and 10, the control mechanism M3 comprises a hollow cylindrical control shaft 70 as a control member driven by the drive mechanism M2, and control links 71*i*, 71*e* for transmitting the motion of the control shaft 70 to the link mechanisms M1*i*, M1*e* to thereby swing the link mechanisms M1*i*, M1*e* about the camshaft 50.

The control shaft 70 is movable in parallel to the cylinder axis L1, i.e., movable in parallel to the reference plane H0 which includes the rotational center line L2 and is parallel to the cylinder axis L1.

The control links 71*i*, 71*e* are constituted of the intake control link 71*i* and the exhaust control link 71*e*. The intake control link 71*i* is pivotally supported on the control shaft 70 at a connection portion 71*i*1 serving as a first intake connection portion, and is pivotally supported on the connection portion 61*i*1 of the first plate 61*i* of the intake link mechanism M1*i* at a connection portion 71*i*2 serving as a second intake connection portion. The exhaust control link 71*e* is pivotally supported on the control shaft 70 at a connection portion 71*e*1 serving as a first exhaust connection portion, and is pivotally supported on the connection portion 61*e*1 of the first plate 61*e* of the exhaust link mechanism M1*e* at a connection portion 71*e*2 serving as a second exhaust connection portion. The connection portion 71*i*1 of the intake control link 71*i* and the connection portion 70*a* of the control shaft 70 each have a hole into which one connection pin 71*e*3 fixed by being press fitted into a hole in the connection portion 71*e*1 of the exhaust control link 71*e* is relatively rotatably inserted, and are pivotally supported on the connection pin 71*e*3, whereas the bifurcated connection portions 71*i*2, 71*e*2 (see FIG. 7(D)) have holes into which connection pins 61*i*1*a*, 61*e*1*a* of the connection portions 71*i*2, 71*e*2 are relatively rotatably inserted, and they are pivotally supported on the connection pins 61*i*1*a*, 61*e*1*a*, respectively. At the connection portions 71*e*1 (71*i*1), 70*a* provided with slight gap due to the pivotal supporting, the connection portion 71*e*1 (71*i*1) is normally pressed against the connection portion 70*a* by the spring force of the pressing spring, so that the influence of the gap (play) between the connection portion 71*e*1 (71*i*1) and the connection portion 70*a* is eliminated, and the motion of the control shaft 70 is accurately transmitted to the exhaust control link 71*e* (intake control link 71*i*).

Figure 8:
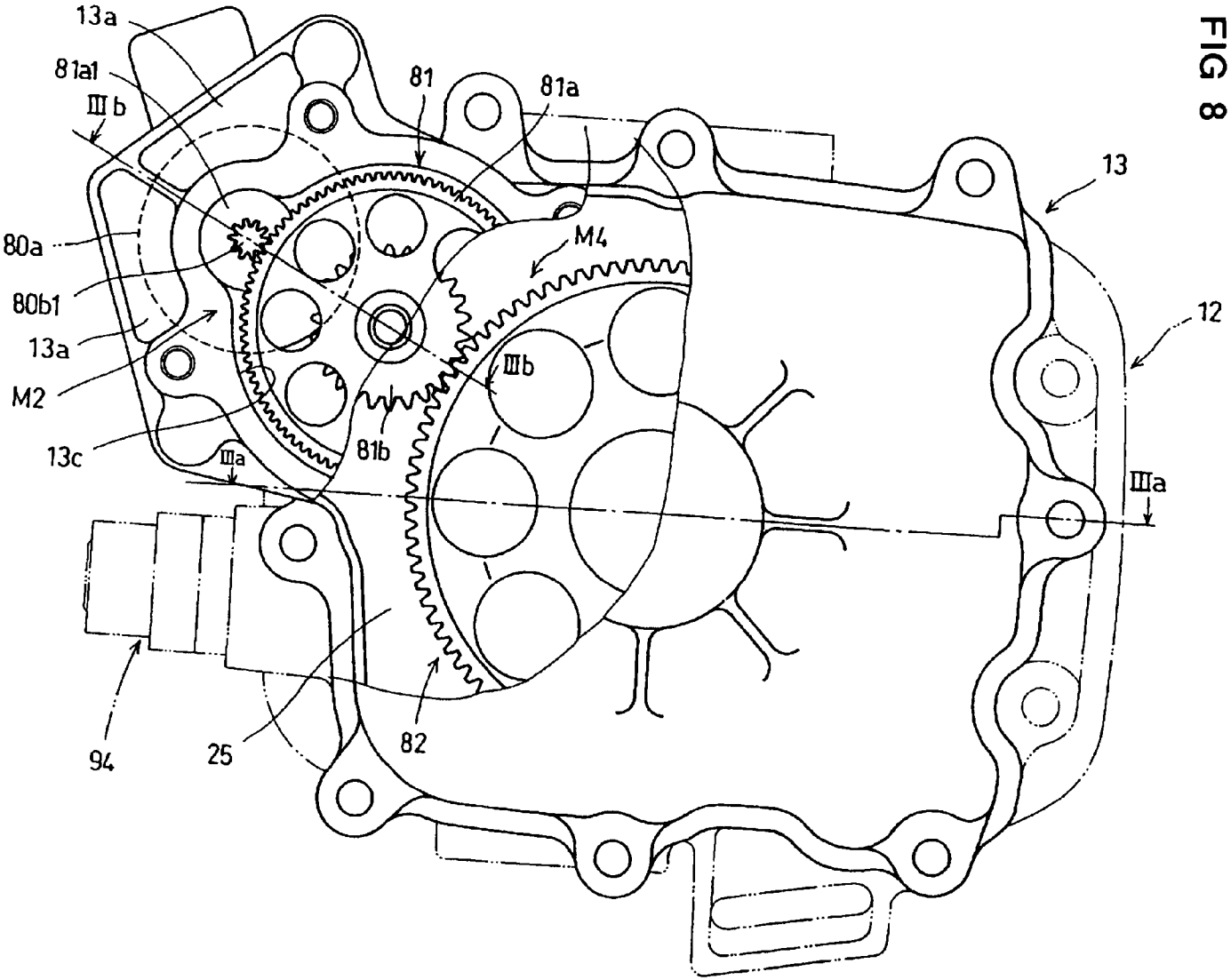
FIG. 8 is a view of the head cover in the internal combustion engine of FIG. 1 as viewed along the cylinder axis from the front side, with a drive mechanism of the valve characteristic varying mechanism shown in partly broken state.

Referring to FIGS. 3 and 8, the drive mechanism M2 for driving the control shaft 70 comprises an electric motor 80 capable of reverse rotation and mounted to the head cover 13, and a transmission mechanism M4 for transmitting the rotation of the electric motor 80 to the control shaft 70. The control mechanism M3 and the drive mechanism M2 are disposed on the opposite side of the cylinder 11 and the combustion chamber 16, with respect to a second orthogonal plane H2 which includes the rotational center line L2 and is orthogonal to the reference plane H0.

The electric motor 80 comprises a hollow cylindrical main body 80*a* in which a heating portion such as a coil portion is contained and which has a center axis parallel to the cylinder axis L1, and an output shaft 80*b* extending in parallel to the cylinder axis L1. The electric motor 80 is disposed on the outer side in the radial direction of the valve chamber 25, in relation to the cylinder head 12 and the head cover 13. The power transmission chamber 59 is disposed on the left side of the first orthogonal plane H1, and the main body 80*a* and the spark plug 19 are disposed on the right side, i.e. the other side, of the first orthogonal plane H1. In the main body 80*a*, a mounted portion 80*a*1 to be connected to a mount portion 13*a* formed in an eaves-like shape on the head cover 13 to project in the radial direction is provided with a through-hole 80*a*2, and the output shaft 80*b* penetrates through the through-hole 80*a*2 to project to the exterior of the main body 80*a* and extends into the valve chamber 25. The main body 80*a* is disposed at such a position that the whole part thereof is covered by the mount portion, as viewed in the cylinder axis direction A1 from the side of the head cover 13, or as viewed from the front side of the head cover 13 (see FIG. 8).

Referring to FIGS. 2, 3 and 8, in the valve chamber 25, the transmission mechanism M4 disposed between the camshaft holder 29 and the head cover 13 in the cylinder axis direction A1 is composed of a speed reduction gear 81 meshed with a drive gear 80*b*1 formed on the output shaft 80*b* penetrating through the head cover 13 and extending into the valve chamber 25, and an output gear 82 which is meshed with the speed reduction gear 81 and is rotatably supported on the cylinder head 12 through the camshaft holder 29. The speed reduction gear 81 is rotatably supported on a support shaft 84 supported by the head cover 13 and a cover 83 for covering an opening 13*c* formed in the head cover 13, and has a large gear 81*a* meshed with the drive gear 80*b*1, and a small gear 81*b* meshed with the output gear 82. The output gear 82 has a hollow cylindrical boss portion 82*a* which is rotatably supported, through a bearing 89, on a holding tube 88 connected to the camshaft holder 29 by bolts.

The output gear 82 and the control shaft 70 are drive connected to each other through a feed screw mechanism serving as a motion conversion mechanism by which the rotational motion of the output gear 82 is converted into a rectilinear reciprocating motion, parallel to the cylinder axis L1, of the control shaft 70. The feed screw mechanism comprises a female screw portion 82*b* composed of a trapezoidal screw formed in the inner circumferential surface of the boss portion 82*a*, and a male screw portion 70*b* composed of a trapezoidal screw formed in the outer circumferential surface of the control shaft 70 and meshed with the female screw portion 82*b*. The control shaft 70 is slidably fitted over the outer circumference of a guide shaft 90 fixed to the boss portion 82*a*, and can be advanced and retracted relative to the camshaft 50 in the cylinder axis direction A1 through a through-hole 91 (see FIG. 5 also) formed in the camshaft holder 29, while being guided in the moving direction by the guide shaft 90.

Referring to FIG. 3, the electric motor 80 is controlled by an electronic control unit (hereinafter referred to as ECU) 92. For this purpose, detection signals are inputted to the ECU 92 from operating condition detection means 93, which is composed of starting detection means for detecting the starting time of the internal combustion engine E, load detection means for detecting the engine load, engine speed detection means for detecting the engine speed, and the like and which detects the operating conditions of the internal combustion engine E, and from swing position detection means 94 (composed, for example, of a potentiometer) for detecting the swing position, or the swing angle relative to the camshaft 50, of the holder 60*e* of the exhaust link mechanism M1*e* swung by the electric motor 80, hence of the exhaust cam 54.

Therefore, when the position of the control shaft 70 driven by the electric motor 80 is changed, the swing position which is the rotation position of the exhaust link mechanism M1*e* (intake link mechanism M1*i*) and the exhaust cam 54 (intake cam 53) relative to the camshaft 50 is changed according to the operating conditions, so that the valve operation characteristics of the exhaust valve 23 (intake valve 22) are controlled according to the operating conditions of the internal combustion engine E by the valve characteristic varying mechanism M controlled by the ECU 92.

Details of the above will be described below.

Figure 9:
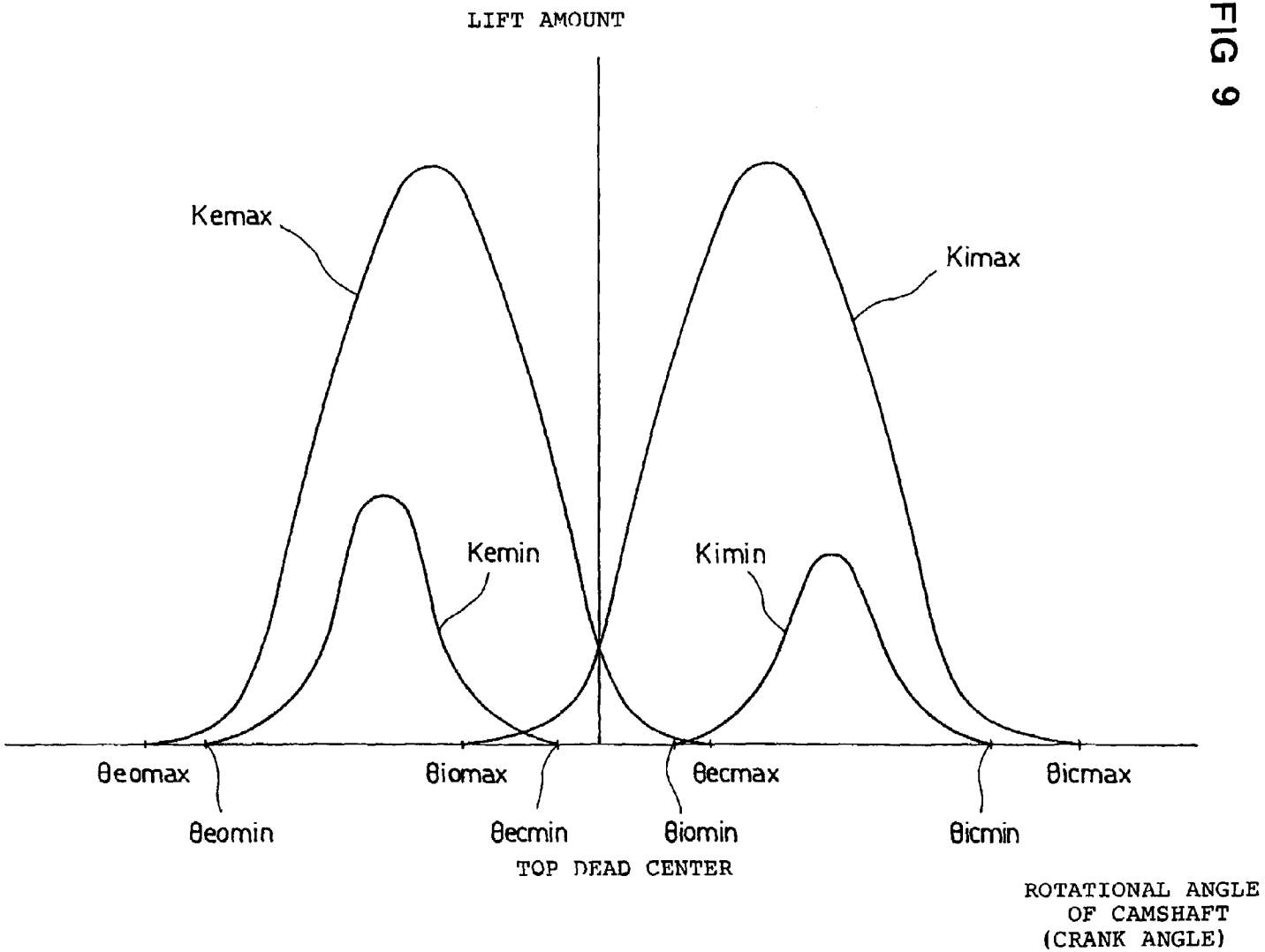
FIG. 9 is an illustration of the valve operation characteristics of the intake valve and the exhaust valve effected by the valve system for the internal combustion engine of FIG. 1.

As shown in FIG. 9, the intake valve and the exhaust valve are respectively put into opening and closing operations with arbitrary intermediate valve operation characteristics between maximum valve operation characteristics Kimax, Kemax and minimum valve operation characteristics Kimin, Kemin, with the maximum valve operation characteristics Kimax, Kemax and the minimum valve operation characteristics Kimin, Kemin as boundary values of basic operation characteristics of valve operation characteristics Ki, Ke controlled by the valve characteristic varying mechanism M for changing the opening and closing timings and the maximum lift amounts. Therefore, regarding the intake valve 22, as the opening timing is continuously retarded on an angle basis, the closing timing is continuously advanced on an angle basis to continuously shorten the valve opening period, further, the rotational angle of the camshaft 50 (or the crank angle as a rotational position of the crankshaft 15) for obtaining the maximum lift amount is continuously retarded on an angle basis, and the maximum lift amount is continuously reduced. Simultaneously with the changes in the valve operation characteristics of the intake valve 22, regarding the exhaust valve 23, as the opening timing is continuously retarded on an angle basis, the closing timing is continuously advanced to continuously shorten the valve opening period, further, the rotational angle of the camshaft 50 for obtaining the maximum lift amount is continuously advanced on an angle basis, and the maximum lift amount is continuously reduced.

Referring to FIG. 10 also, when the control shaft 70 driven by the drive mechanism M2 and the intake control link 71*i* occupy first positions shown in FIGS. 10(A), 10(B), the maximum valve operation characteristic Kimax is obtained such that the opening timing of the intake valve 22 is at a most advanced angle position θ iomax, the closing timing is at a most retarded angle position θ icmax, and the valve opening period and the maximum lift amount are both maximized; simultaneously, the maximum valve operation characteristic Kemax is obtained such that the opening timing of the exhaust valve 23 is at a most advanced angle position θ eomax, the closing timing is at a most retarded angle position θ ecmax, and the valve opening period and the maximum lift amount are both maximized.

Incidentally, in FIGS. 10 and 11, the conditions of the exhaust link mechanism M1*e* (intake link mechanism M1*i*) and the exhaust main rocker arm 42 (intake main rocker arm 41) at the time when the exhaust valve 23 (intake valve 22) is closed are indicated by solid lines and broken lines, whereas the general conditions of the exhaust link mechanism M1*e* (intake link mechanism M1*i*) and the exhaust main rocker arm 42 (intake main rocker arm 41) at the time when the exhaust valve 23 (intake valve 22) is opened at the maximum lift amount are indicated by two-dotted chain lines.

During transition from the condition where the maximum valve operation characteristics Kimax, Kemax are obtained by the valve characteristic varying mechanism M to the condition where the minimum valve operation characteristics Kimin, Kemin are obtained, according to the operating conditions of the internal combustion engine E, the electric motor 80 drives the output gear 72 to rotate, and the control shaft 70 is advanced toward the camshaft 50 by the feed screw mechanism. In this instance, based on the drive amount of the electric motor 80, the control shaft 70 swings the intake link mechanism M1*i* and the intake cam 53 in the rotational direction R1 about the camshaft 50 through the intake control link 71*i*, and, simultaneously, swings the exhaust link mechanism M1*e* and the exhaust cam 54 in the counter-rotational direction R2 about the camshaft 50 through the exhaust control link 71*e*.

When the control shaft 70 and the exhaust control link 71*e* occupy second positions shown in FIGS. 11(A), 11(B), the minimum valve operation characteristic Kimax is obtained such that the opening timing of the intake valve 22 is at a most retarded angle position θ iomin, the closing timing is at a most advanced angle position θ icmin, and both the valve opening period and the maximum lift amount are minimized; simultaneously, the minimum valve operation characteristic Kemin is obtained such that the opening timing of the exhaust valve 23 is at a most retarded angle position θ eomin, the closing timing is at a most advanced angle position θ ecmin, and both the valve opening period and the maximum lift amount are minimized.

During transition of the control shaft 70 from the second position to the first position, the electric motor 80 drives the output gear 82 to rotate in the reverse direction, and the control shaft 70 is retracted away from the camshaft 50 by the feed screw mechanism. In this instance, the control shaft 70 swing the intake link mechanism M1*i* and the intake cam 53 in the counter-rotational direction R2 about the camshaft 50 through the intake control link 71*i*, and, simultaneously, swing the exhaust link mechanism M1*e* and the exhaust cam 54 in the rotational direction R1 about the camshaft 50 through the exhaust control link 71*e*.

In addition, when the control shaft 70 occupies a position between the first position and the second position, regarding the exhaust valve 23 (intake valve 22), innumerable intermediate valve characteristics are obtained such that the opening timing, the closing timing, the valve opening period and the maximum lift amount are set at values respectively between the opening timing, the closing timing, the valve opening period and the maximum lift amount at the maximum valve operation characteristic Kemax (Kimaxa) and those at the minimum valve operation characteristic Kemin (Kimin).

The intake valve and the exhaust valve are put into opening and closing operations with auxiliary operation characteristics, in addition to the above-mentioned basic operation characteristics, by the valve characteristic varying mechanism M. Specifically, the fact that decompression operation characteristics as the auxiliary operation characteristics can be obtained will be described referring to FIGS. 12(A), 12(B). During the compression stroke upon the starting of the internal combustion engine E, the electric motor 80 drives the output gear 82 to rotate in the reverse direction, and the control shaft 70 occupies a decompression position where it is retracted beyond the first position so as to be located away from the camshaft 50. In this case, the exhaust link mechanism M1*e* (intake link mechanism M1*i*) and the exhaust cam 54 (intake cam 53) are swung in the rotational direction R1 (counter-rotational direction R2), the decompression cam 62*e*1 (62*i*1) of the second plate 62*e* (62*i*) makes contact with a decompression portion 42*d* (41*d*) provided in the vicinity of the roller 42*c* (41*c*) of the exhaust main rocker arm 42 (intake main rocker arm 41), the roller 42*c* (41*c*) parts from the exhaust cam 54 (intake cam 53), and the exhaust valve 23 (intake valve 22) is opened at a small decompression opening.

Now, the functions and effects of the embodiment constituted as above will be described below.

The exhaust control link 71*e* (intake control link 71*i*) and the holder 60*e* (60*i*) in the valve characteristic varying mechanism M are pivotally connected at the connection portion 71*e*2 (71*i*2) and the connection portion 61*e*1 (61*i*1), and the valve characteristic varying mechanism M comprises the pressing spring 55 for normally pressing the connection portion 61*e*1 (61*i*1) against the connection portion 71*e*2 (71*i*2) in the swinging direction and for normally pressing the connection portion 71*e*1 (71*i*1) against the connection portion 70*a*, whereby the influence of the play between the connection portions 71*e*2 (71*i*2) and 61*e*1 (61*i*1) when the holder 60*e* (60*i*) is swung by the exhaust control link 71*e* (71*i*) is eliminated, so that the exhaust control link 71*e* (intake control link 71*i*) and the holder 60*e* (60*i*) are normally held in a contact condition at the connection portions 71*e*2 (71*i*2), 61*e*1 (61*i*1) thereof, while the exhaust control link 71*e* (intake control link 71*i*) and the control shaft 70 are normally held in a contact condition by the connection portions 71*e*1 (71*i*1), 70*a*, and the motion of the control mechanism M3 is accurately transmitted to the holder 60*e* (60*i*). Therefore, lowering in motion transmission accuracy due to the play at the connection portions 71*e*2 (71*i*2), 61*e*1 (61*i*1) between the exhaust control link 71*e* (intake control link 71*i*) and the holder 60*e* (60*i*) and the play at the connection portions 71*e*1 (71*i*1), 70*a* between the exhaust control link 71*e* (intake control link 71*i*) and the control shaft 70 is obviated, and the accuracy in control of the valve operation characteristics controlled according to the swing position of the holder 60*e* (60*i*) driven by the electric motor 80 through the exhaust control link 71*e* (intake control link 71*i*) is enhanced.

The sense in which the spring force of the pressing spring 55 presses the connection portion 61*e*1 (61*i*1) against the connection portion 71*e*2 (71*i*2) in the swinging direction and the sense in which the spring force normally presses the connection portion 71*e*1 (71*i*1) against the connection portion 70*a* is the same as the sense in which the reaction force applied from the exhaust valve 23 (intake valve 22) to the exhaust cam 54 (intake cam 53) when the exhaust cam 54 (intake cam 53) opens the exhaust valve 23 (intake valve 22) in the swinging direction, whereby it is ensured that the spring force of the pressing spring 55 is not canceled by the reaction force applied from the exhaust valve 23 (intake valve 22), and the contact condition between the exhaust control link 71*e* (intake control link 71*i*) and the holder 60*e* (60*i*) is maintained irrespectively of the opening and closing operations of the exhaust valve 23 (intake valve 22). Therefore, the motion of the control mechanism M3 is accurately transmitted to the holder 60*e* (60*i*), and a highly accurate control of the valve operation characteristics is maintained. In addition, since the spring force of the pressing spring 55 need not overcome the reaction force, the spring force of the pressing spring 55 can be set small insofar as the contact condition between the control mechanism M3 and the holder 60*e* (60*i*) is maintained, and the abrasion of the connection portions 71*e*2 (71*i*2), 61*e*1 (61*i*1) due to sliding is restrained. Therefore, the durability at the connection portions is enhanced, a highly accurate control of the valve operation characteristics is maintained over a long time, and the pressing spring 55 is reduced in size and weight.

The valve characteristic varying mechanism M comprises swing position detection means 94 for detecting the swing position of the holder 60*e* (60*i*) for the purpose of controlling the drive amount of the electric motor 80, and the detecting portion 94*a* of the swing position detection means 94 performs a motion by being engaged with the detected portion 62*e*2 of the holder 60*e* (60*i*) in the swinging direction, whereby the detected portion 62*e*2 is engaged with the detection portion 94*a* in the state of being normally pressed against the detecting portion 94*a* in the swinging direction by the spring force of the pressing spring 55. Therefore, the influence of the play between the detected portion 62*e*2 and the detecting portion 94*a* is eliminated, and the detecting portion 94*a* performs a swinging motion while accurately following up to the swinging motion of the holder 60*e* (60*i*). Since the swing position of the holder 60*e* (60*i*) is detected by the swing position detection means 94 based on the swinging of the detecting portion 94*a*, the swinging motion is accurately detected by the swing position detection means 94, and the accuracy in detection of the swing position of the holder 60*e* (60*i*), hence of the exhaust cam 54, is enhanced, so that the accuracy of the valve operation characteristics by the valve characteristic varying mechanism M controlled by the electric motor 80 controlled by the ECU 92 based on the detection results is further enhanced.

The valve characteristic varying mechanism M comprises the control spring 68 for pressing the exhaust sub rocker arm 66*e* (intake sub rocker arm 66*i*) against the exhaust drive cam 52 (intake drive cam 51), and the collar 63*e* (63*i*) of the holder 60*e* (60*i*) is provided with the movable side spring holding portion 78 for holding one end portion of the pressing spring 55 and with a first spring holding portion 76 for holding one end portion of the control spring 68. The pressing spring 55 and the control spring 68 are both held by the collar 63*e* (63*i*) provided with the spring holding portions 76, 78. Therefore, it is unnecessary to provide the spring holding portions 76, 78 in other separate members, and the structure of the valve characteristic varying mechanism M is simplified.

The valve characteristic varying mechanism M comprises the first and second spring holding portions 76, 77 for respectively holding both end portions of the control spring 68 composed of a compression coil spring having a straight hollow cylindrical shape in the natural state. The spring guides 76*a*, 77*a* of the spring holding portions 76, 77 each have the base portion 76*a*1, 77*a*1 into which an end portion of the control spring 68 is fitted in the state of being inhibited from moving in the radial direction, and the tapered portion 76*a*2, 77*a*2 which is continuous with the base portion 76*a*1, 77*a*1 and tapered so as to obviate interference with the control spring 68 when the control spring 68 is curved due to the rocking of the exhaust sub rocker arm 66*e* (intake sub rocker arm 66*i*). Since the control spring 68 is composed of a spring which has a straight hollow cylindrical shape in the natural state and is inexpensive, the control spring 68 is low in cost, so that the cost of the valve system 40 is reduced. In addition, since the spring guides 76*a*, 77*a* are each inserted into the inside of an end portion of the control spring 68 and are held by the base portions 76*a*1, 77*a*1 in the state of being inhibited from moving in the radial direction, the spring guides 76*a*, 77*a* would not be disengaged from the spring holding portions 76, 77 even at the time of extension and contraction of the control spring 68 due to the rocking of the exhaust sub rocker arm 66*e* (intake sub rocker arm 66*i*), and the control spring 68 is assuredly held by the spring holding portions 76, 77. Further, since the control spring 68 is prevented, by the presence of the tapered portions 76*a*2, 77*a*2, from making contact with the spring guides 76*a*, 77*a* when curved into an arcuate shape due to the rocking of the exhaust sub rocker arm 66*e* (intake sub rocker arm 66*i*), the durability of the control spring 68 is enhanced.

The valve characteristic varying mechanism M comprises the movable side and fixed side spring holding portions 78, 79 for respectively holding both end portions of the pressing spring 55 composed of a compression coil spring having a straight hollow cylindrical shape in the natural state. The spring guides 78*a*, 79*a* of the spring holding portions 78, 79 have the base portions 78*a*1, 79*a*1 and the tapered portions 78*a*2, 79*a*2 similar to those of the spring guides 76*a*, 77*a* of the first and second spring holding portions 76, 77. This ensures that the pressing spring 55 is assuredly held by the spring holding portions 78, 79 even at the times of extension and contraction of the pressing spring 55 due to the swinging of the holder 60*e* (60*i*) swung by the control mechanism M driven by the electric motor 80. Further, since the pressing spring 55 is prevented, by the presence of the tapered portions 78*a*2, 79*a*2, from making contact with the spring guides 78*a*, 79*a* when curved into an arcuate shape due to the swinging of the holder 60*e* (60*i*), the durability of the pressing spring 55 is enhanced.

In the condition where the first and second spring holding portions 76, 77 are closest to each other, the control spring 68 assumes a substantially straight hollow cylindrical shape, and, in the condition where the movable side and fixed side spring holding portions 78, 79 are closest to each other, the pressing spring 55 assumes a substantially straight hollow cylindrical shape. This ensures that the control spring 68 and the pressing spring 55 are securely prevented from being disengaged from the spring holding portions 76, 77, 78, 79 in the state of generating maximum spring forces.

Now, an embodiment obtained by partly changing the constitution of the above-described embodiment will be described below, in special regard of the modifications.

The internal combustion engine E may be a multi-cylinder internal combustion engine. Further, the internal combustion engine E may be an internal combustion engine in which one cylinder is provided with a plurality of intake valves and one or a plurality of exhaust valves, or may be an internal combustion engine in which one cylinder is provided with a plurality of exhaust valves and one or a plurality of intake valves.

The electric motor 80 may be mounted to the cylinder head 12. The swing position detection means 94 may detect the swing position of the holder 60*i* of the intake link mechanism M1*i*.

Although embodiments of the present invention have been described thus far, the present invention is not limited to the examples in the drawings and the embodiments described above, and various modifications may be made without departing the scope of the present invention, as a matter of course.

We claim:

1. A valve system for an internal combustion engine, comprising a valve characteristic varying mechanism which comprises a valve cam pivotally supported on a camshaft so as to open and close an engine valve composed of an intake valve or an exhaust valve, a holder pivotally supported on said camshaft, a control mechanism driven by a drive mechanism so as to swing said holder about said camshaft, and a rocker arm pivotally supported on said holder and swung by a drive cam rotated integrally with said camshaft, so as to swing said valve cam about said camshaft, said valve characteristic varying mechanism controlling the valve operation characteristics of said engine valve according to the swing position of said holder, wherein said control mechanism and said holder are connected so as to be capable of relative motions through a control mechanism side connection portion and a holder side connection portion, and said valve characteristic varying mechanism comprises a pressing energizing means for normally pressing said holder side connection portion against said control mechanism side connection portion in the swinging direction.

2. A valve system for an internal combustion engine as set forth in claim 1, wherein the direction in which an energizing force of said pressing energizing means presses said holder side connection portion against said control mechanism side connection portion is the same as the direction in which a reaction force exerted on said valve cam by said engine valve when said valve cam opens said engine valve presses said holder side connection portion against said control mechanism side connection portion.

3. A valve system for an internal combustion engine as set forth in claim 1 comprising a swing position detection means for detecting the swing position of said holder for the purpose of controlling the drive amount of said drive mechanism, wherein a detecting portion of said swing position detection means moves while being engaged with said holder in the swinging direction.

4. A valve system for an internal combustion engine as set forth in claim 1 to wherein said valve characteristic varying mechanism comprises a control spring for pressing said rocker arm against said drive cam, said pressing energizing means is a pressing spring, and said holder is provided with a spring holding portion for holding one end portion of said pressing spring and with a spring holding portion for holding one end portion of said control spring.

5. A valve system for an internal combustion engine as set forth in claim 1 wherein said valve characteristic varying mechanism comprises a control spring composed of a compression coil spring having a straight hollow cylindrical shape in the natural state so as to press said rocker arm against said drive cam, and a pair of spring holding portions for respectively holding both end portions of said control spring, each of said spring holding portions has a spring guide inserted into the inside of said end portion, and said spring guide has a base portion over which said end portion is fitted in the state of being inhibited from moving in the radial direction thereof, and a tapered portion continuous with said base portion and tapered so as to obviate interference with said control spring when said control spring is curved by swinging of said rocker arm.

* * * * *